US010876808B2

(12) United States Patent
Paspaliaris

(10) Patent No.: US 10,876,808 B2
(45) Date of Patent: Dec. 29, 2020

(54) FIREARM STABILIZATION DEVICE

(71) Applicant: Paspa Pharmaceuticals Pty Ltd, Victoria (AU)

(72) Inventor: Vasilis Paspaliaris, Victoria (AU)

(73) Assignee: Paspa Pharmaceuticals Pty Ltd, Victoria (AU)

( * ) Notice: Subject to any disclaimer, the term of this patent is extended or adjusted under 35 U.S.C. 154(b) by 0 days.

(21) Appl. No.: 16/572,063

(22) Filed: Sep. 16, 2019

(65) Prior Publication Data

US 2020/0200498 A1 Jun. 25, 2020

Related U.S. Application Data

(63) Continuation of application No. 16/217,426, filed on Dec. 12, 2018, now Pat. No. 10,415,918, which is a continuation of application No. PCT/US2018/046512, filed on Aug. 13, 2018.

(60) Provisional application No. 62/545,816, filed on Aug. 15, 2017.

(51) Int. Cl.

| | |
|---|---|
| ***F41A 21/30*** | (2006.01) |
| ***F41A 27/24*** | (2006.01) |
| ***F41C 27/22*** | (2006.01) |
| ***F41G 3/12*** | (2006.01) |
| *F41G 11/00* | (2006.01) |

(52) U.S. Cl.

CPC ..... *F41A 21/30* (2013.01); *F41A 27/24* (2013.01); *F41C 27/22* (2013.01); *F41G 3/12* (2013.01); *F41G 11/003* (2013.01)

(58) Field of Classification Search

CPC ..... F41A 21/30; F41A 27/24; F41C 27/22; F41G 3/12

See application file for complete search history.

(56) References Cited

U.S. PATENT DOCUMENTS

| | | | | |
|---|---|---|---|---|
| 1,382,174 A * | 6/1921 | Buckham | F41G 5/16 | 114/191 |
| 2,014,825 A * | 9/1935 | Watson | G05D 3/1481 | 318/445 |
| 2,391,965 A * | 1/1946 | Hanna | F41G 5/16 | 89/41.01 |
| 2,723,596 A * | 11/1955 | Buchanan | F41G 5/16 | 89/41.09 |
| 3,078,728 A * | 2/1963 | Schlesman | G01C 19/025 | 74/5.7 |

(Continued)

OTHER PUBLICATIONS

International Search Report for Int'l App. No. PCT/US2018/046512, dated Oct. 18, 2018.

*Primary Examiner* — Michelle Clement

(74) *Attorney, Agent, or Firm* — Knobbe Martens Olson & Bear LLP

(57) ABSTRACT

A firearm stabilization device is described that can be attached to a firearm to improve, increase, or maintain the stability of a firearm. The firearm stabilization device may include an electric motor configured to rotate a flywheel about an axis of rotation and a power source powering the electric motor. The electric motor, the flywheel, and the power source may be positioned within a housing. The fire arm stabilization device may include an engagement structure positioned on an outer surface of the housing for attaching (releasably or permanently) the firearm stabilization device to a firearm.

20 Claims, 12 Drawing Sheets

(56) References Cited

U.S. PATENT DOCUMENTS

| | | | | | |
|---|---|---|---|---|---|
| 3,165,972 | A * | 1/1965 | Cumbo | F41C 27/22 | 74/5.7 |
| 3,396,630 | A * | 8/1968 | Hinterthur | F41G 5/16 | 89/41.09 |
| 3,502,062 | A * | 3/1970 | Shurts | F41B 5/1426 | 124/23.1 |
| 3,871,236 | A * | 3/1975 | De la Cierva | F41G 5/16 | 74/5.22 |
| 4,621,266 | A * | 11/1986 | Le Gall | H01Q 1/18 | 342/359 |
| 4,662,727 | A * | 5/1987 | Griffin | G02B 27/644 | 356/139.05 |
| 5,113,745 | A * | 5/1992 | Allen | F41C 27/22 | 89/14.05 |
| 7,870,814 | B2 * | 1/2011 | Lounsbury | F41G 3/12 | 42/1.06 |
| 8,220,448 | B1 * | 7/2012 | Moggo | F41G 3/12 | 124/89 |
| 9,146,068 | B2 * | 9/2015 | Hodgson | F41G 3/12 | |
| 9,354,013 | B2 * | 5/2016 | Hodgson | F41A 21/30 | |
| 10,203,179 | B2 * | 2/2019 | Hodgson | F41A 21/30 | |
| 2007/0144338 | A1 * | 6/2007 | Gerstadt | F41A 27/24 | 89/41.09 |
| 2010/0281726 | A1 | 11/2010 | Lounsbury | | |
| 2011/0167692 | A1 | 7/2011 | Lounsbury | | |
| 2013/0152445 | A1 | 6/2013 | Compton | | |
| 2015/0377579 | A1 | 12/2015 | Hodgson | | |
| 2016/0377372 | A1 * | 12/2016 | Hodgson | F41A 21/30 | 42/1.06 |

* cited by examiner

FIREARM STABILIZATION DEVICE

INCORPORATION BY REFERENCE TO ANY PRIORITY APPLICATIONS

This application is a continuation of U.S. patent application Ser. No. 16/217,426, filed Dec. 12, 2018, which is a continuation of Patent Cooperation Treaty Application No. PCT/US2018/046512, filed Aug. 13, 2018, which claims priority to U.S. Provisional Application No. 62/545,816, filed Aug. 15, 2017, each of which are incorporated herein by reference. Any and all applications for which a foreign or domestic priority claim is identified in the Application Data Sheet as filed with the present application are hereby incorporated by reference under 37 CFR 1.57.

BACKGROUND

Field

This disclosure relates generally to firearms, and in particular, to firearm stabilization devices and systems that can be attached to a firearm to improve the stability and accuracy of the firearm.

Description

Firearm use is common in a variety of tactical and recreational settings. In almost every instance, the ability to precisely aim the firearm is desired. One factor in achieving precise aim is the ability to maintain the firearm in a stable position. A number of shooting techniques and training programs seek to improve a shooter's ability to hold the firearm in a stable position while aiming and pulling the trigger. Still, most shooters experience a degree of wobble or instability while aiming, pulling the trigger, and discharging the weapon.

This Background is provided to introduce a brief context for the Summary and Detailed Description that follow. This Background is not intended to be viewed as limiting the claimed subject matter to implementations that solve any or all of the disadvantages or problems presented herein.

SUMMARY

In a first aspect, a firearm stabilization device comprises a housing extending along an axis between a first open end and a second open end. The housing includes a first compartment separated from a second compartment by an interior wall. The device includes a gyroscope assembly positioned within the first compartment. The gyroscope assembly comprises a flywheel mounted on a rotatable shaft. The flywheel and the rotatable shaft are configured to rotate around an axis of rotation. An end of the rotatable shaft extends through an opening in the interior wall into the second compartment. A first end cap is attached to and closes the first open end of the housing. A drive assembly is positioned within the second compartment. The drive assembly comprises a motor mount including a first portion attached to the interior wall and a second portion spaced apart from the interior wall to define a coupling space between the interior wall and the second portion, wherein the end of the rotatable shaft is positioned within the coupling space, an electric motor attached to the motor mount, an output shaft of the electric motor extending though the second portion into the coupling space, wherein the output shaft is aligned with the axis of rotation, a coupling positioned within the coupling space and operably connecting the output shaft of the electric motor to the rotatable shaft of the gyroscope assembly such that the electric motor is configured to rotate the flywheel, and a power source electrically connected to the electric motor. The device also comprises a second end cap attached to and closing the second open end of the housing, the second end cap including a button electrically connected to the electric motor and the power source for controlling the electric motor, and an attachment mechanism positioned on an outer surface of the housing for fixedly attaching the stabilization device to a barrel of a firearm such that, in an attached state, the axis of rotation of the flywheel is parallel to a central axis of the barrel.

In some embodiments, the attachment mechanism comprises a quick release assembly. In some embodiments, the quick release assembly comprises a first clamping jaw fixedly attached to the outer surface of the housing, a moveable second jaw, and a handle actuable to move the second clamping jaw toward the first clamping jaw. In some embodiments, the first clamping jaw and the second clamping jaw are configured to attach to an accessory rail on the barrel of the firearm. In some embodiments, the accessory rail comprises a NATO accessory rail. In some embodiments, the attachment mechanism comprises a magnet for magnetically attaching the stabilization device to a corresponding magnetic connector on the barrel of the firearm. In some embodiments, the attachment mechanism comprises a magnet having an upper surface with a profile configured to magnetically engage the barrel of the firearm. In some embodiments, the attachment mechanism is removable from the firearm stabilization device. In some embodiments, the attachment mechanism comprises a keyed engagement structure configured to align the axis of rotation to the central axis of the barrel. In some embodiments, a layer of foam or insulation material is positioned on an inner surface of the housing in at least a portion of the second compartment. In some embodiments, the layer of foam or insulation material is at least 1 mm thick. In some embodiments, the layer of foam or insulation material is at least 3 mm thick. In some embodiments, the power source comprises a plurality of batteries positioned radially around the electric motor within the second compartment. In some embodiments, the electric motor is positioned axially between the power source and the gyroscope assembly. In some embodiments, the stabilization device is configured to attach to the barrel no more than 25 cm from the end of the barrel distal to the user. In some embodiments, the stabilization device is configured to attach to the barrel no more than 15 cm from the end of the barrel distal to the user. In some embodiments, the stabilization device is configured to attach to the barrel no less than 5 cm from the end of the barrel distal to the user. In some embodiments, the stabilization device is configured to attach to the barrel between a midpoint of the barrel and an end of the barrel distal to the user. In some embodiments, the barrel comprises a length and the stabilization device is configured to attach to the barrel no more than 15% the length of barrel from an end of the barrel distal to the user. In some embodiments, the barrel comprises a length and the stabilization device is configured to attach to the barrel no more than 10% the length of barrel from an end of the barrel distal to the user. In some embodiments, the stabilization device is configured to attach to the barrel at least 5% the length of barrel from the end of the barrel distal to the user. In some embodiments, the stabilization device is configured to attach to the barrel between a center of gravity of the firearm and an end of the barrel distal to the user. In some embodiments, the stabilization device is configured to attach to the barrel between a foregrip of the firearm and an end of the barrel distal to the user. In some embodiments, in the attached state, the axis of rotation and the central axis of the barrel are not coaxial. In some embodiments, in the attached state, the axis of rotation is positioned below the central axis of the barrel. In some embodiments, in the attached state, the axis of rotation is spaced apart from the central axis of the barrel by between 2 cm and 8 cm. In some embodiments, the device further comprises a rubber overmold on the housing. In some embodiments, the firearm stabilization device is less than 20 cm long but greater than 5 cm long. In some embodiments, the housing is cylindrical and an outer diameter of the housing is less than 7 cm but greater than 3 cm. In some embodiments, an outer diameter of the flywheel is 5 cm or less (but not zero) and greater than 2 cm. In some embodiments, the device further comprises a first seal between the first end cap and the first open end, and a second seal between the second end cap and the second open end. In some embodiments, the stabilization device is waterproof. In some embodiments, wherein, during operation, the stabilization device produces less than 50 decibels, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances. In some embodiments, wherein, during operation, the stabilization device produces less than 30 decibels of sound, such as below 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances. In some embodiments, a first end of the rotatable shaft is supported by a first bearing attached to the first end cap, and a second of the rotatable shaft is supported a second bearing attached to the interior wall. In some embodiments, the first bearing is at least partially received in a first recess in the first end cap, and the second bearing is at least partially received in a second recess in the interior wall. In some embodiments, the first bearing is held into the first recess by a first bearing cap attached to the first end cap, and the second bearing is held into the second recess by a second bearing cap attached to the interior wall. In some embodiments, the device further comprises a first O-ring positioned between the first bearing and the first recess, and a second O-ring positioned between the second bearing and the second recess.

In another aspect, a firearm stabilization system comprises a mount configured to attach to a barrel of a firearm within at least 15% of the a length of the barrel from an end of the barrel distal to a user, the mount including a first engagement structure that is positioned below the barrel of the firearm when the mount is attached to the barrel; a firearm stabilization device comprising: an electric motor configured to rotate a flywheel about an axis of rotation and a power source powering the electric motor, the electric motor, the flywheel, and the power source positioned within a housing, and a second engagement structure positioned on an outer surface of the housing, the second engagement structure releasably engaging the first engagement structure of the mount to releasably attach the firearm stabilization device to the mount such that the axis of rotation of the flywheel is parallel to a central axis of the barrel.

In some embodiments, the first engagement structure comprises a NATO accessory rail. In some embodiments, the second engagement structure comprises a quick release assembly configured to attach to the NATO accessory rail. In some embodiments, the first engagement structure comprises a first magnet, and wherein the second engagement structure comprises a second magnet magnetically connected to the first magnet. In some embodiments, the mount is configured to surround the barrel. In some embodiments, the firearm stabilization device is positioned below the barrel. In some embodiments, the housing of the firearm stabilization device comprises: a first portion, comprising the flywheel, the electric motor, and a first electrode end; and a second portion comprising the power source and a second electrode end; wherein the first portion is attached to the second portion by engagement of the first electrode end and the second electrode end; and wherein engagement of the first electrode end and the second electrode end electrically connects the power source to the electric motor. In some embodiments, the first electrode end threadingly engages the second electrode end. In some embodiments, the power source is rechargeable, and wherein the firearm stabilization device comprises a port for charging the power source. In some embodiments, when the firearm stabilization device is attached to the mount, a distance between the axis of rotation and the central axis of the barrel is 8 cm or less but greater than 2 cm. In some embodiments, when the firearm stabilization device is attached to the mount, the axis of rotation and the central axis of the barrel are not coaxial. In some embodiments, the firearm stabilization device is less than 20 cm long but greater than 5 cm. In some embodiments, the housing is cylindrical and an outer diameter of the housing is less than 7 cm but greater than 3 cm. In some embodiments, during operation, the stabilization device produces less than 50 decibels, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances. In some embodiments, said firearm is a pistol or a rifle.

In another aspect, use of the firearm stabilization system as described above to stabilize the barrel of a firearm and/or to improve the accuracy of the firearm, preferably while, during operation, producing less than 50 decibels of sound from said firearm stabilization system, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances is described.

In another aspect, a method of using the firearm stabilization system described above and herein to stabilize a firearm and/or to improve accuracy of the firearm is disclosed. The method includes providing the firearm stabilization system to attach to a firearm.

The foregoing is a summary and contains simplifications, generalization, and omissions of detail. Those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1A:
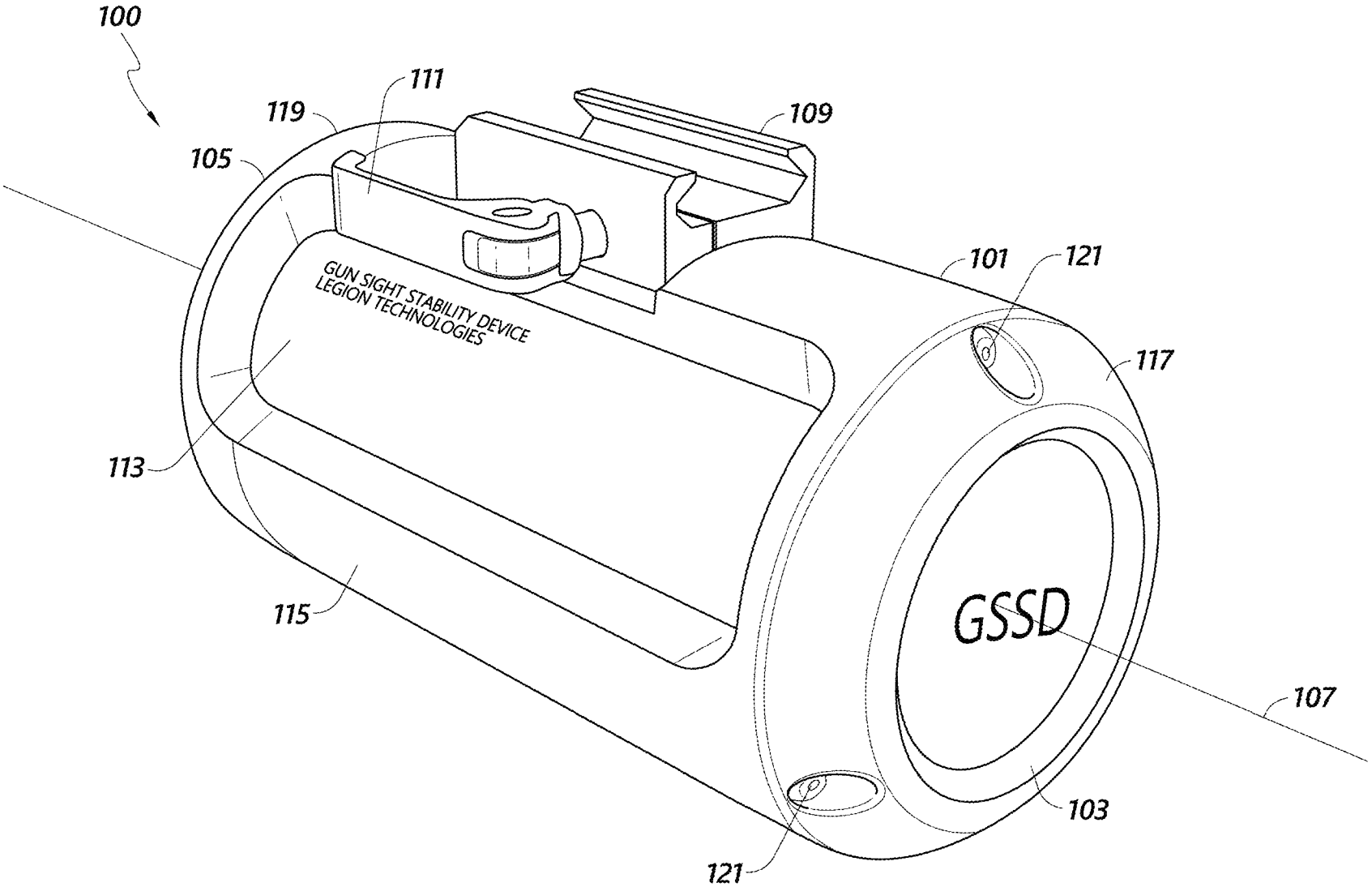
FIG. 1A is a perspective view of an embodiment of a firearm stabilization device.

This disclosure relates generally to firearm stabilization devices and systems, as wells as, methods of use thereof. As will be described in detail below, a firearm stabilization device can be attached to a firearm to improve, increase, or maintain the stability and/or accuracy of the firearm (e.g., a pistol or rifle). The firearm stabilization device may include an electric motor configured to rotate a flywheel about an axis of rotation and a power source for powering the electric motor. The electric motor, the flywheel, and the power source may be positioned within a housing. The firearm stabilization device may include an engagement structure positioned on an outer surface of the housing for attaching (releasably or permanently) the firearm stabilization device to the firearm. The firearm stabilization device may be provided in a compact form that can easily and quickly be attached to and removed from the firearm. The firearm stabilization device may be configured for quiet or silent operation (e.g., operating at auditory level that is below a threshold or amount detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances). These and other features of the device will become apparent from the following description.

In the following detailed description, reference is made to the accompanying drawings, which form a part hereof. In the drawings, similar symbols typically identify similar components, unless context dictates otherwise. The illustrative embodiments described in the detailed description and drawings are not intended to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

FIG. 1A is a perspective view of an embodiment of a firearm stabilization device 100 (referred to herein as the device 100). Although not visible in FIG. 1A, the device 100 includes a gyroscope assembly 135 and a drive assembly 137 (see FIGS. 1C-1E described below). The drive assembly 135 causes rotation of the gyroscope assembly 137. Rotation of gyroscope assembly 137 creates a stabilizing force that resists motion in directions that are not parallel to the axis of rotation of the gyroscope assembly 137. When attached to a firearm (e.g., a pistol or rifle), the device 100 can increase the stability of the firearm and thereby the accuracy of the firearm. Accordingly, a user's ability to precisely and accurately aim and discharge the firearm can be improved by the device 100. In some embodiments, the device 100 is provided in an unobtrusive and simple to use package or form factor that can quickly and simply be attached to a firearm to provide added stability and greater accuracy than in the absence of the device 100.

Figure 9:
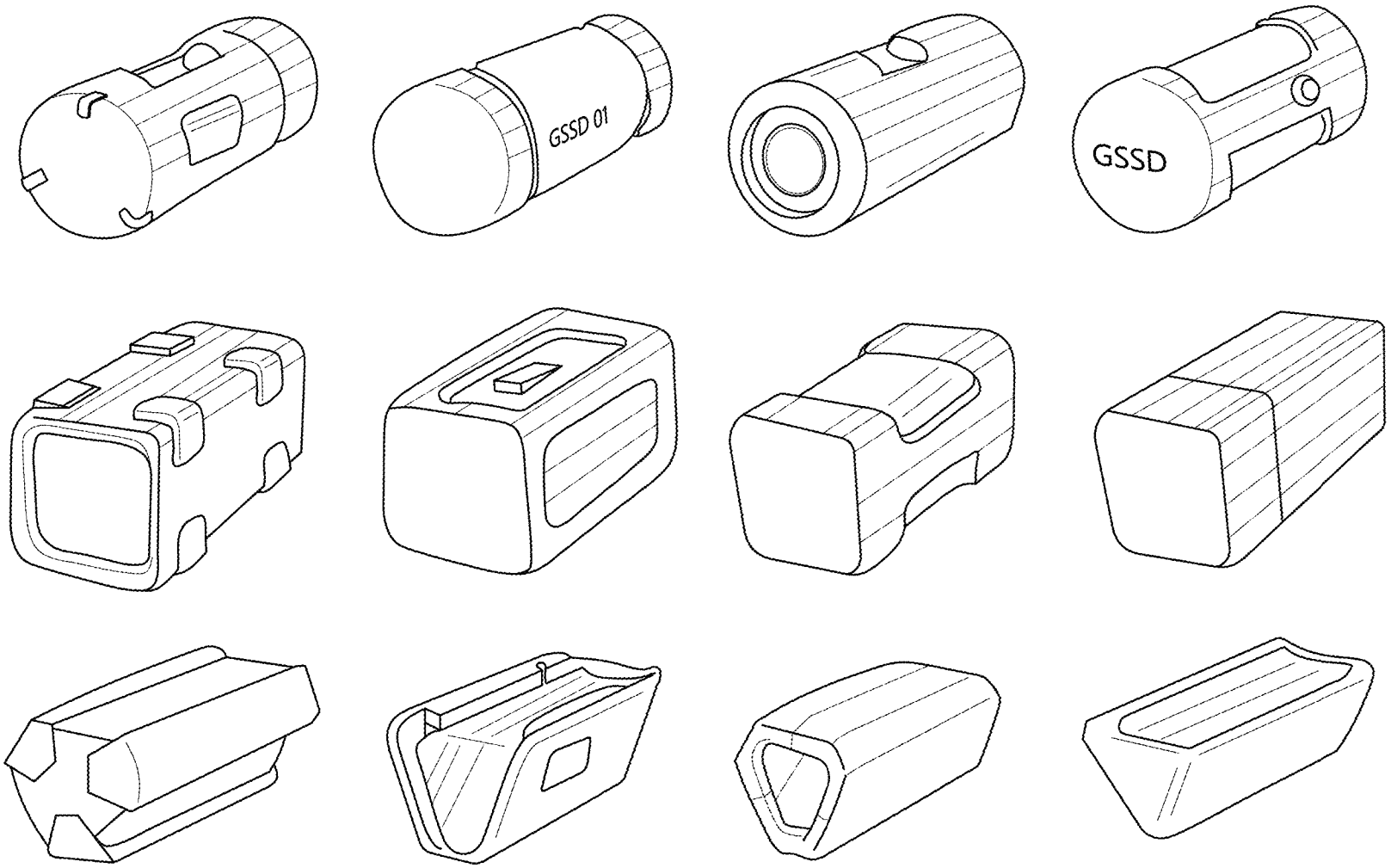
FIG. 9 illustrates various additional embodiments of a firearm stabilization device.

As illustrated in FIG. 1A, the device 100 includes a body 101. The body 101 extends between a first end 103 and a second end 105. In the illustrated embodiment, the body 101 extends along an axis 107 such that first end 103 is located opposite the second end 105. The axis 107 may be a longitudinal or central axis of the device 100. In the illustrated embodiment, the body 101 comprises a generally rounded or circular cross-sectional shape, such that the body 101 is shaped generally cylindrically. Other shapes for the body 101 are contemplated (see, for example, FIG. 9). For example, the body 101 may comprise other cross-sectional shapes, such as triangular, square, oval, etc. Several additional examples of devices 100 including different shaped bodies 101 are shown in FIG. 9. Further, in some embodiments, the body 101 does not extend along an axis and/or the first end 103 need not be opposite the second end 105.

In some embodiments, the body 101 can include a housing 113. The housing 113 can include one or more interior compartments formed therein. One or more internal components of the device 100 (such as a gyroscope assembly 135 and a drive assembly 137) can be positioned within the interior compartments. The interior components of the device 100, including embodiments of the gyroscope assembly and the drive assembly, will be described in greater detail with reference to FIGS. 1C-1E below.

The housing 113 of the body 101 may comprise a rigid material, such as metal or plastic. In one embodiment, the housing 113 comprises aluminum, such as extruded aluminum, although this disclosure should not be limited to only this example. A wide variety of suitable materials are available as will be apparent to those of ordinary skill in the art.

As illustrated, for some embodiments, the body 101 comprises an overmolded portion 115 formed over at least a portion of the housing 113. The overmolded portion 115 may comprise a cushioning and/or insulating material. In some embodiments, the overmolded portion 115 comprises a rubber material. In the illustrated embodiment, the overmolded portion 115 comprises ribs of rubber material formed over the housing 113. The ribs extend longitudinally along the exterior of the housing in a direction parallel to the axis 107. The overmolded portion 115 may be formed in a variety of patterns or positions on the housing 115 without limit. In some embodiments, the overmolded portion 115 extends over the entirety of the housing 113. In some embodiments, the housing 113 is formed as a unitary piece (see, for example, FIG. 1C). In some embodiments, the housing 113 comprises a plurality of pieces joined together (see, for example, FIGS. 8A and 8B).

The overmolded portion 115 can be configured to provide cushioning, insulation, and/or protection for the device 100. The overmolded portion 115 can be configured to provide a texture or pattern, which improves the gripability of the device 100. The overmolded portion 115 can be configured to provide waterproofing or water resistance for the device 100 (e.g., sealing gaps or seams in the housing 113). The overmolded portion 115 can be configured to provide sound dampening for the device 100 (e.g., the overmolded portion 115 can be configured to make the device 100 quieter during operation, such as producing a level of sound that is not readily heard by the user and/or others within the vicinity of the device 100). In some embodiments, device 100 operates at an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances. The overmolded portion 115 can also be configured to improve the aesthetics of the device 100.

As illustrated, for some embodiments, the device 100 includes an attachment mechanism 109. The attachment mechanism 109 can be configured to allow the device 100 to be attached to a firearm. In some embodiments, the attachment mechanism 109 attaches directly to the firearm. In some embodiments, the attachment mechanism 109 attaches to a corresponding attachment mechanism coupled to the firearm. In some embodiments, the attachment mechanism 109 attaches to an accessory rail on the firearm. The attachment mechanism 109 can be configured in a variety of shapes and sizes selected to attach to a wide variety of commonly used firearm accessory rails, such as NATO accessory rails, Picatinny accessory rails, Weaver accessory rails, or others.

In the illustrated embodiment, the attachment mechanism 109 is configured to allow for a quick connect assembly for attachment to a NATO accessory rail. The attachment mechanism 109 comprises a locking handle 111 that can be pivoted between open and closed positions to secure the attachment mechanism 109 to the NATO accessory rail. As shown in the end view of FIG. 1B, the attachment mechanism 109 may also comprise an adjustment knob 112. The adjustment knob 112 may be positioned opposite the locking handle 111. One embodiment of the quick connect assembly for the attachment mechanism 109 is illustrated in greater detail in FIG. 5, and will be described further below. Additional embodiments of attachment mechanisms 109 are shown in FIGS. 6-7.

As described below with reference to FIGS. 4A and 4B, when the device 100 is attached to the firearm (e.g., a pistol or rifle), the position and/or alignment of the device 100 on the firearm may be an important factor in the device 100 to stabilize the firearm and thereby provide greater firearm accuracy.

As shown in FIG. 1A, the device 100 can comprise a first end cap 117. The first end cap 117 can be configured to cover and seal an opening of the first end 103 of the housing 113. In the illustrated embodiment, the first end cap 117 is attached to the housing 113 by fasteners 121. As illustrated, the fasteners 121 can comprise mechanical fasteners, such as screws, bolts, or rivets, etc. In some embodiments, other methods or mechanisms can be used for attaching the first end cap 117 to the first end 103, such as adhesive or welds. In some embodiments, a portion of the first end cap 117 and a portion of the housing 113 are threaded, such that the first end cap 117 can be threaded onto the housing 113. The first end cap 117 can be removably attachable to the housing 113. The first end cap 117 can be permanently attached to the housing 113. The first end cap 117 can be integrally formed with the housing 113.

Figure 1B:
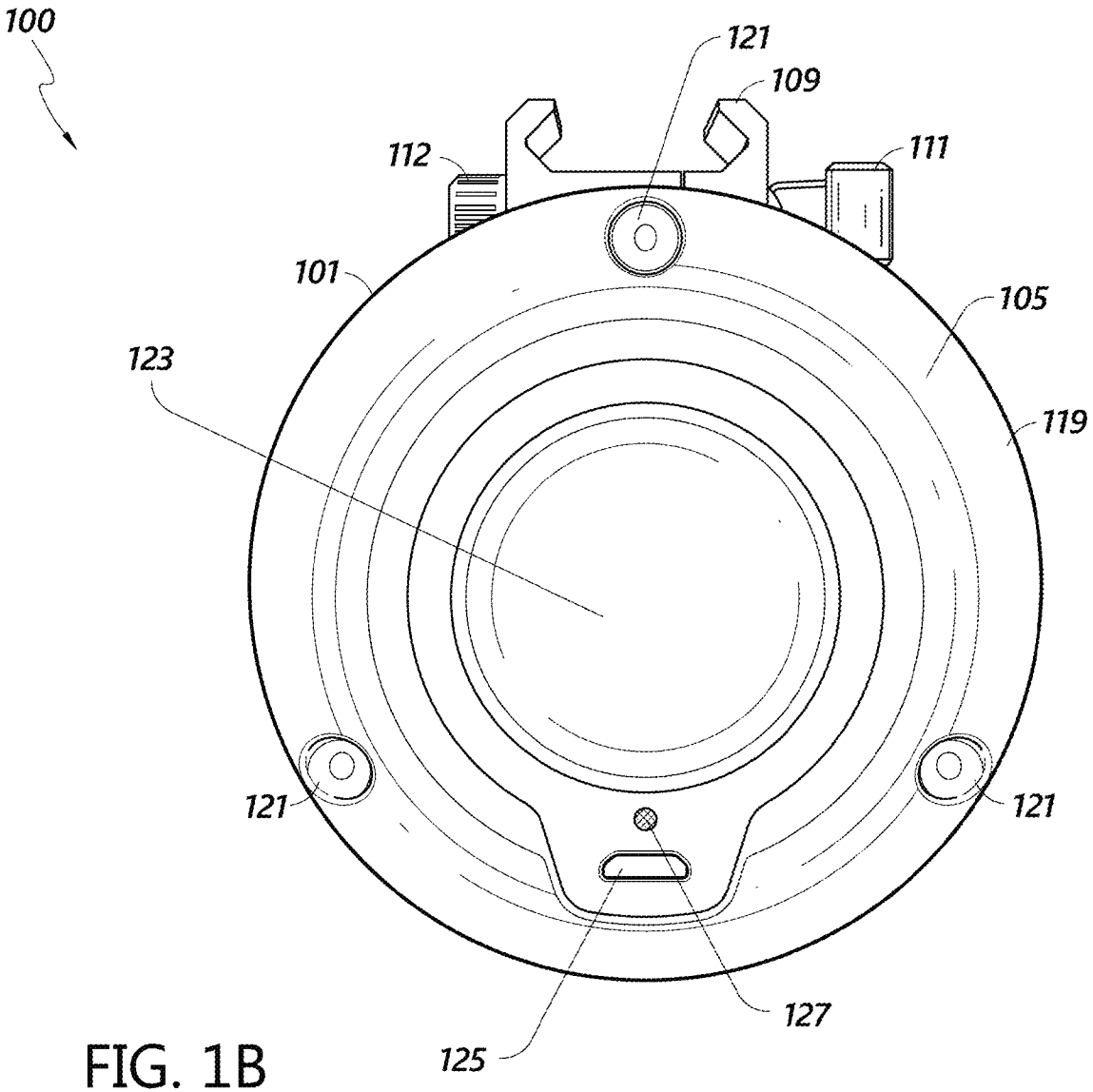
FIG. 1B is an end view of the firearm stabilization device of FIG. 1A.

FIG. 1B is an end view of the device 100. The end-view of FIG. 1B shows the second end 105 of the device 100. In the illustrated embodiment, the device 100 comprises a second end cap 119. The second end cap 119 can be configured to cover and seal an opening of the second end 105 of the housing 113. In the illustrated embodiment, the second end cap 119 is attached to the housing 113 by fasteners 121, similar to the first end cap 117 described above. As illustrated, the fasteners 121 can comprise mechanical fasteners, such as screws, bolts, or rivets, etc. In some embodiments, other methods or mechanisms can be used for attaching the second end cap 119 to the second end 105, such as adhesive or welding. In some embodiments, a portion of the second end cap 119 and a portion of the housing 113 are threaded, such that the second end cap 119 can be threaded onto the housing 113. The second end cap 119 can be removably attachable to the housing 113. The second end cap 119 can be permanently attached to the housing 113. The second end cap 119 can be integrally formed with the housing 113.

As illustrated, the second end 105 comprises an actuator 123. The actuator 123 is operable to receive user input from a user for controlling the device 100. In the illustrated embodiment, the actuator 123 comprises a button, although this disclosure is not to be limited only this example. The actuator 123 may comprise a toggle, dial, keypad, or any other user input device. Although only a single actuator 123 is illustrated, in some embodiments, a plurality of actuators 123 is included. In some embodiments, a single actuator 123 may be preferred as this may allow simplified control of the device 100. For example, a single actuator 123 can be used to turn the device 100 on and off. As another example, the single actuator 123 can be used to toggle through a plurality of operational modes, for example, off, low speed, and high speed. In some embodiments, the actuator 123 may be used to turn on the device 100, and the device 100 may include a timer configured to power off the device 100 after a period of time, such as 10 seconds, 20 seconds, or 30 seconds, or within a range of time defined by any two of the aforementioned time points or for a time period that is shorter or longer than these time points.

The device 100 may also comprise a port 125 as illustrated. The port 125 may be a charging port for charging an internal power source (e.g., one or more batteries) of the device 100. A charging cable can be connected between the port 125 and an external power source (e.g., external battery, AC outlet, 12-volt DC outline in a vehicle, etc.) to charge the internal power source. In some embodiments, the port 125 is a power port for direct connection to an external power source. For example, if the device 100 does not include an internal power source or the internal power source is depleted, the port 125 can be connected to an external power source to provide power to operate the device 100. In some embodiments, the port 125 is a USB port, a micro-USB port, a mini-USB port, or another suitable port configured to charge a device.

The device 100 may also comprise one or more indicators 127. In the illustrated embodiment, the indicator 127 is illustrated as and a light emitting diode (LED). The indicator can provide information regarding the status or operation of the device 100 or the status of charging of the battery or batteries of the device 100 to the user. For example, in the case of an LED, the color and or pattern with which the light flashes may be used to indicate whether the device 100 is on or off, whether the device 100 has power, whether the device 100 is charging, etc. Different colored indicators (e.g., green can indicate fully charged, yellow can indicate partial charge, and red can indicate low or no charge) can also be used. Although only a single indicator 127 is illustrated, the device 100 may include a plurality of indicators 127. Further, the indicator(s) 127 may take many forms, such as a speaker, a display, or a haptic (e.g., vibration-based) indicator, among others.

In some embodiments, one or more of the features (e.g., the actuator 123, the port 125, and the indicator 127) illustrated on the second end 105 (or on the second end cap 119) may be included, instead or additionally, on the first end 103 (or on the first end cap 117). In some embodiments, one or more of the features illustrated on the second end 105 (or on the second end cap 119) may be included, instead or additionally, on other portions of the body 101.

Figure 1C:
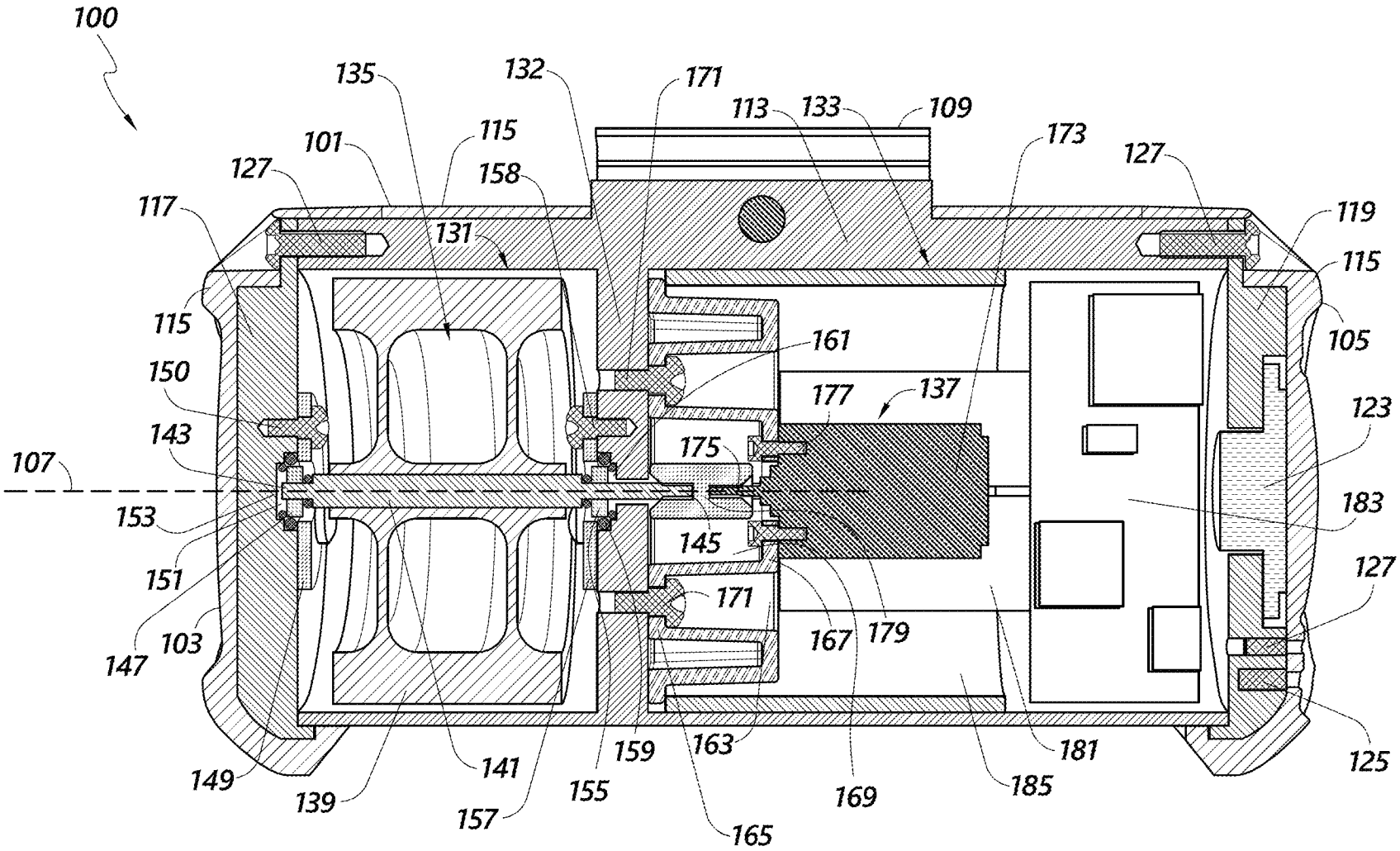
FIG. 1C is a longitudinal cross-sectional view of the firearm stabilization device of FIG. 1A.
Figure 1D:
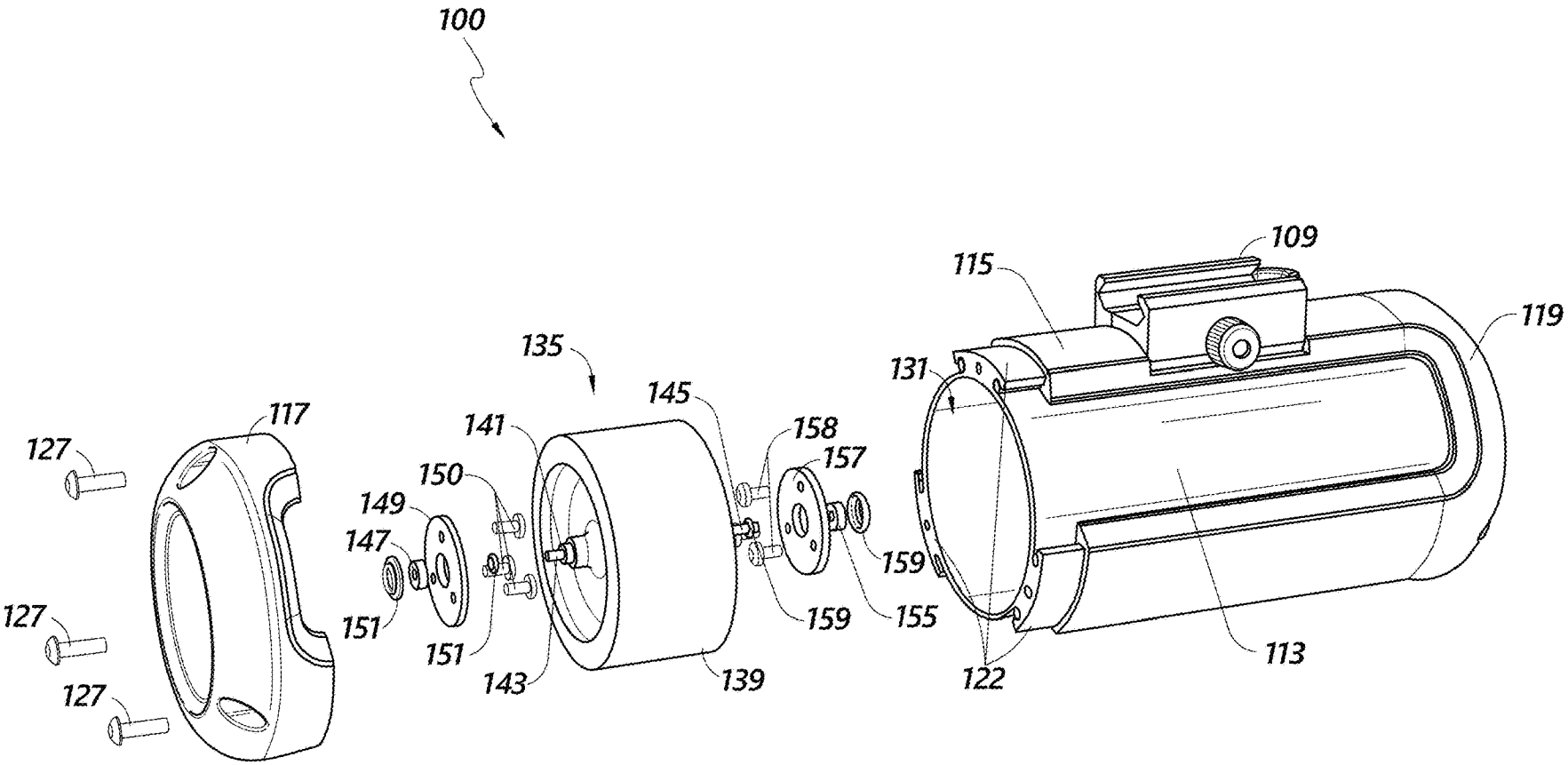
FIG. 1D is a first partially exploded view of the firearm stabilization device of FIG. 1A, illustrating components of an embodiment of a gyroscope assembly of the device.
Figure 1E:
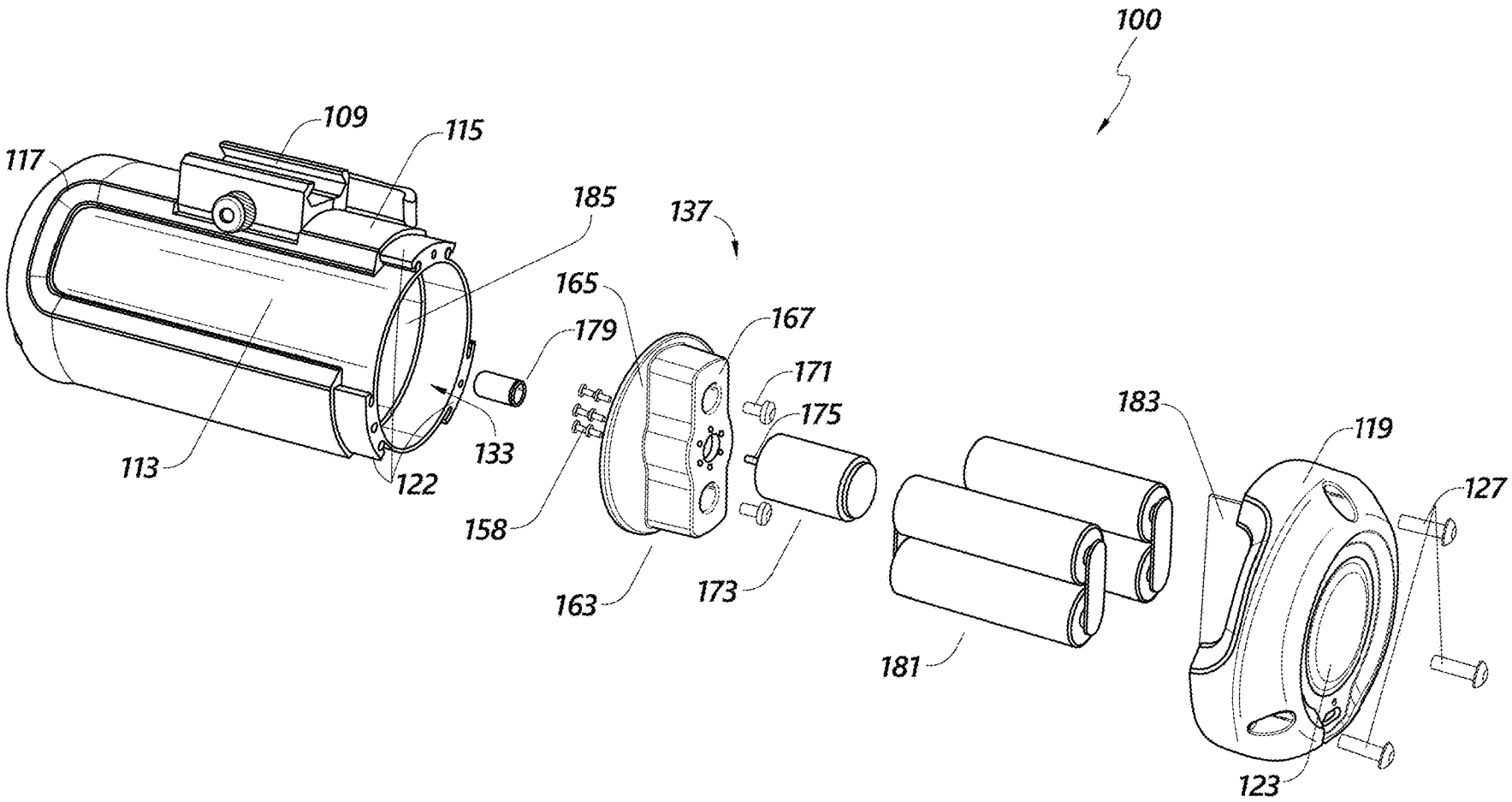
FIG. 1E is a second partially exploded view of the firearm stabilization device of FIG. 1A, illustrating components of an embodiment of a drive assembly of the device.

FIGS. 1C-1E illustrate internal components of the device 100. FIG. 1C is a longitudinal cross-sectional view of the device 100. As illustrated in FIG. 1C, the housing 113 of the device 100 includes a first compartment 131 and a second compartment 133. The first compartment 131 is separated from the second compartment 133 by an interior wall 132. In the illustrated embodiment, the first compartment 131 is smaller (e.g., shorter measured along the axis 107) than the second compartment 133. This need not be the case in all embodiments. The first compartment 131 can be the same size as the second compartment 133. The first compartment 131 can be larger than the second compartment 133. As illustrated, the interior wall 132 can be integrally formed with the housing 113. The interior wall 132 can extend in a plane generally orthogonal to the axis 107. In some embodiments, the interior wall 132 may be omitted and the first and second compartments 131, 133 may be combined. As illustrated, the first compartment 131 is closed on the first end 103 by the first end cap 117, and the second compartment 133 is closed on the second end 105 by the second end cap 119.

A gyroscope assembly 135 is positioned within the first compartment 131, and a drive assembly 137 is positioned with the second compartment 133. Broadly, the drive assembly 137 is configured to cause rotation of the gyroscope assembly 135 about the axis 107. Rotation of the gyroscope assembly 135 produces stabilizing forces, which resist motion of the device in directions that are not parallel to the axis 107.

FIG. 1D is a first partially exploded view of the device 100, illustrating an exploded view of the components of the gyroscope assembly 135 of the device 100. FIG. 1E is a second partially exploded view of the device 100, illustrating an exploded view of the components the drive assembly 137 of the device 100. With reference first to FIGS. 1C and 1D, the components of the gyroscope assembly 135 will first be described. Then, with reference to FIGS. 1C and 1E, the components of the drive assembly 137 will be described.

With reference to FIGS. 1C and 1D, the gyroscope assembly 135 comprises a flywheel 139. The flywheel 139 may comprise a rotational mass. In some embodiments, the flywheel 139 has a diameter of 2, 3, 4, 5, 6, or 7 cm or is of a diameter that is within a range defined by any two of the aforementioned diameters, such as between 2 cm and 7 cm, between 3 cm and 6 cm, or 5 cm. The flywheel 139 may be configured such that a majority of the mass of the flywheel 139 is positioned at or near the outer diameter of the flywheel 139. For example, as illustrated, an inner portion of the flywheel 139 (e.g., a portion closer to the axis 107) may be configured to comprise recesses or hollow portions, while an outer portion of the flywheel 139 may be solid as illustrated. By distributing the mass towards the outer diameter of the flywheel 139, the rotational moment of inertia of the flywheel 139 about the axis 107 is increased. This may improve the stabilizing characteristics of the gyroscope assembly without increasing the overall diameter of the device 100. As will be described in greater detail below, it may be desired to minimize the overall diameter of the device 100 so as to provide the device in a compact and unobtrusive form. The aforementioned features of flywheel 139 are also configured to reduce or suppress the amount of noise generated by device 100 such that device 100 operates at an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

In some embodiments, the flywheel 139 comprises a heavy metal. In a preferred embodiment, the flywheel 139 comprises copper. By forming the flywheel from a heavy metal, the rotational moment of inertia can again be increased without increasing the overall size of the device. This may provide the benefit of improving the stabilizing abilities of the device 100 while still maintaining a compact form. The aforementioned features of flywheel 139 are also configured to reduce or suppress the amount of noise generated by device 100 such that device 100 operates at an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

The flywheel 139 is mounted on a rotatable shaft 141. The flywheel 139 may be fixedly mounted to the rotatable shaft 114 such that the flywheel 139 and the rotatable shaft 141 rotate together. The flywheel 139 may be press fit onto the rotatable shaft 141. The flywheel 139 may be attached to the rotatable shaft 141 by adhesive or welding. The flywheel 139 may be attached to the rotatable shaft 141 by a mechanical fastener, such as a grub screw extending through the flywheel 139 into the rotatable shaft 141. In some embodiments, the rotatable shaft 141 and the flywheel 139 are integrally formed. In general, the rotatable shaft 141 extends along the axis 107.

As illustrated, the rotatable shaft 141 extends through the flywheel 139. A first end 143 of the rotatable shaft 141 extends out from a first side of the flywheel 139. The diameter of the rotatable shaft 141 may narrow at the first end 143. A second end of the rotatable shaft 145 extends out for a second side of the flywheel 139. The diameter of the rotatable shaft 141 may narrow at the second end 145. As illustrated, for some embodiments, the second end 145 extends further away from second side of the flywheel 139 than the first end 143 extends away from the first side of the flywheel 139. As will be described below, this may allow a portion of the second end 145 to extend into the second compartment 133.

The first and second ends 143, 145 of the rotatable shaft 141 are supported by first and second bearings 147, 155, respectively. The bearings 147, 155 may be ring bearings, ball bearings, or any other type of bearing. The bearings 147, 155 are configured to allow the rotatable shaft 141 and the flywheel 139 attached thereto to rotate around the axis 107 relative to the reminder of the device 100. In some embodiments, the diameter of the first and/or second bearings 147, 155 is 1 cm or less (but not zero). In preferred embodiments, the diameter of the first and/or second bearings 147, 155 is 6, 5, 4, 3, 2, or 1 mm or within a range defined by any two of the aforementioned diameters. Use of other size bearings is also possible. The aforementioned features of the first and/or second bearings are also configured to reduce or suppress the amount of noise generated by device 100 such that device 100 operates at an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

The first bearing 147 receives the first end 143 of the rotatable shaft 141. As illustrated, for some embodiments, a portion of the first bearing 147 is at least partially received within a recess 153 formed on the inner surface of the first end cap 117. To secure the first bearing 147 within the recess 153, a first bearing cap 149 may be used. The first bearing cap 149 can comprise a flat disc having a hole formed therethrough (through which the first end 143 of the rotatable shaft 141 extends), e.g., like a washer. The first bearing cap 149 can be secured to the inner surface of the first end cap 117. In the illustrated embodiment, fasteners 150 (e.g., mechanical fasteners) attach the first bearing cap 149 to the first end cap 117. Other attachment methods (e.g., adhesive, etc.) can be used. The first bearing 147 is sandwiched between the first end cap 117 and the first bearing cap 149, retaining the first bearing 147 in the recess 153. In another embodiment, as illustrated, the first bearing 147 is received partially within the opening in the first bearing cap 149. The first bearing cap 149 thus ensures that the first bearing 147 remains aligned with the axis 107.

Spacers, such as O-rings 151 can also be used to maintain alignment of the first bearing 147 with the axis 107 and/or dampen vibration and/or sound from the device 100. In the illustrated embodiment, three O-rings are provided, which surround the first bearing 147. A first O-ring can be positioned between the back wall of the recess 153 and the first bearing 147. A second O-ring can be positioned around the first bearing 147. A third O-ring can be positioned on the first end 143 of the rotatable shaft 141 between the rotatable shaft 141 and the first bearing 147. The aforementioned features of the O-rings 151 are also configured to reduce or suppress the amount of noise generated by device 100 such that device 100 operates at an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

Opposite the first bearing 147, the second bearing 155 receives the second end 145 of the rotatable shaft 141. As mentioned above, the second end 145 may extend through the second bearing 155 and into the second compartment 133. As illustrated, for some embodiments, a portion of the second bearing 155 is at least partially received within a recess 161 formed on a surface of the interior wall 132. To secure the second bearing 155 within the recess 161, a second bearing cap 157 may be used. The second bearing cap 157 may be similar to the first bearing cap 149. The second bearing cap 157 can be secured to the surface of the interior wall 132. In the illustrated embodiment, fasteners 158 (e.g., mechanical fasteners) attach the second bearing cap 155 to the interior wall 132. Other attachment methods (e.g., adhesive, etc.) can be used. The second bearing 155 is sandwiched between the interior wall 132 and the second bearing cap 157, retaining the second bearing 155 in the recess 161. In another embodiment, as illustrated, the second bearing 155 is received partially within the opening in the second bearing cap 157. The second bearing cap 157 thus ensures that the second bearing 155 remains aligned with the axis 107.

Spacers, such as O-rings 159 can also be used to maintain alignment of the second bearing 155 with the axis 107 and/or dampen vibration and/or sound from the device 100. In the illustrated embodiment, three O-rings are included surrounding the second bearing 155. A first O-ring can be positioned between the back wall of the recess 161 and the second bearing 155. A second O-ring can be positioned around the second bearing 155. A third O-ring can be positioned on the second end 145 of the rotatable shaft 141 between the rotatable shaft 141 and the second bearing 155. The aforementioned features of O-rings 159 are also configured to reduce or suppress the amount of noise generated by device 100 such that device 100 operates at an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

The gyroscope assembly 135 may provide one or more of the following benefits. First, as described above, the shape and material of the flywheel 139 may provide improved stability characteristics while maintaining a compact form factor and reducing or suppressing sound from the device 100. Second, because the flywheel 139 is fully supported on both ends by first and second bearings 147, 155 the flywheel 139 can be very stable during rotation. This stability of the flywheel 139 can reduce vibration and can suppress sound generated by the device 100, which is desirable. Quiet operation may also be desirable, especially in military, police, tactical, or hunting applications. Further, the first bearing 147 is supported by the first end cap 117 and the second bearing 155 is supported by the interior wall 132. This arrangement permits the flywheel 139 to be supported by the housing 117 of the device 100 at locations immediately adjacent, for example, 2 cm or less (but not zero), from the flywheel 139. Again, this may increase stability, decrease vibration, and decrease noise. Similarly, the use of the O-rings 151, 159 may increase stability, decrease vibration, and decrease noise. The unique choice and arrangement of these components work in concert to unexpectedly reduce the sound emitted from the device to an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

With reference now to FIGS. 1C and 1E, the drive assembly 137 is described. The drive assembly 137 is positioned within the second compartment 133. In the illustrated embodiment, the drive assembly 137 comprises a motor 173 and a power source 181. The power source 181 provides power to the motor 173. The motor 173 is coupled to the rotatable shaft 141 of the gyroscope assembly 135 to cause rotation of the flywheel 139 about the axis 107.

As illustrated, the motor 173 is supported within the second compartment 133 by a motor mount 163. A perspective view of an embodiment of the motor mount 163 is shown in FIG. 1E. As shown in FIGS. 1C and 1E, the motor mount 163 is shaped to include a first portion 165 spaced apart from a second portion 167. A coupling space 169 is formed between the first portion 165 and the second portion 167. The motor mount 163 may be formed from rigid plastics, metals, or other suitable materials. The configuration of the motor mount 163 with the motor 173 unexpectedly reduces the sound emitted from the device to an auditory level that is preferably below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

The first portion 165 of the motor mount 163 comprises a flange. The flange can be attached to the interior wall 132 by fasteners 171 (e.g., mechanical or other types of fasteners) to secure the first portion 165 of the motor mount 163 to the interior wall 132. A portion of the motor mount 163 extends away from the flange to form a second portion 167. The second portion 167 can comprise a flat surface having an opening extending therethrough. The motor 173 can be attached to the flat surface of the second portion 167. Fasteners 177 (e.g., mechanical or other types of fasteners) can be used to attach the motor 173 to the second portion 167. In the illustrated embodiment, the fasteners 177 comprise screws extending through the second portion 167 to connect to the motor 173. An output shaft 175 of the motor 173 extends through the opening in the flat surface of the second portion 167. The output shaft 175 of the motor 173 is aligned with the axis 107.

Because the second portion 167 is spaced apart from the first portion 165, a coupling space 169 is formed there between. As illustrated, for some embodiments, the coupling space 169 is a volume within the second compartment 133 that is separated from the remainder of the second compartment 133 by the motor mount 163. The coupling space 169 may be bounded on one side by second portion 167 of the motor mount 163 and on another side by the interior wall 132.

As noted above, the output shaft 175 of the motor 173 extends into the coupling space 169. The second end 145 of the rotatable shaft 141 of the gyroscope assembly 135 extends through the interior wall 132 and into the coupling space 169 in the second compartment 133. Both the rotatable shaft 141 and the output shaft 175 are aligned on the axis 107. A coupling 175 operably couples the output shaft 175 to the rotatable shaft 141. Thus, the motor 173 is operably connected to the flywheel 139 to cause rotation thereof.

In the illustrated embodiment, the coupling 175 comprises a rubber sleeve. The output shaft 175 is received in a first portion of the sleeve and the rotatable shaft 141 is received in a second portion of the sleeve. The coupling 175 may be configured for press fit or friction fit engagement with the output shaft 175 and the rotatable shaft 141. In some embodiments, the coupling 175 is flexible so as to permit for slight misalignment of the output shaft 175 and the rotatable shaft 141. A flexible coupling 175 may also decrease vibration and operational noise of the device 100. Accordingly, the unique choice and arrangement of these components work in concert to unexpectedly reduce the sound emitted from the device to an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

The motor 173 can be an electric motor. The motor 173 can be a DC motor. The motor 173 can be a DC micro-motor. The motor 173 can be an AC motor. The motor 173 can be an AC micro-motor. In some embodiments, the motor 173 is capable of turning the flywheel 139 at least 500 rpms, at least 1,000 rpms, at least 5,000 rpms, at least 10,000 rpms, or at least 15,000 rpms or at a rate that is within a range defined by any two of the aforementioned values.

The drive assembly 137 can also include a power source 181. The power source 181 provides power for the device 100. In the illustrated embodiment, the power source 181 comprises batteries. The batteries may be rechargeable. In some embodiments, the batteries may be lithium-ion batteries. Other types of batteries (e.g., AA, AAA, 9-volt, etc.) may also be used in some embodiments. In some embodiments, the battery or batteries are in a housing that is detachable from the main body of device 100 (e.g., a battery assembly can connect to the main body of device 100 by a screw electrode and said battery assembly can be charged independently of being attached to the main body of device 100). Accordingly, in some embodiments, detachable battery assemblies, which comprise threads, grooves, or an annular ring or a docking mechanism, such as a quarter-turn lock, can be configured for association with the main body of device 100 so as to power device 100 (see FIG. 8B, for example).

The drive assembly 137 may also include a printed circuit board (PCB) 183. The PCB may include a motor controller, processor, or microprocessor for controlling the device 100. The PCB may be electrically connected to the power source 181, the motor 173, the actuator 123, the indicator 125, and/or the port 127.

As illustrated, for some embodiments, a portion of the second compartment 133 includes a lining layer 185. The lining layer 185 may be positioned on an inside surface of the housing 113. The lining layer 185 may comprise foam, fiber or an insulation material. The lining layer 185 may comprise a sound dampening material such as a foam, fiber, or an insulation material. The lining layer preferably comprises an insulating material. In some embodiments, the lining layer advantageously decreases noise created by the device during operation. In some embodiments, the entire inner surface of the second compartment 133 includes the lining layer 185. In some embodiments, the lining layer 185 may also be included in the first compartment 131. In some embodiments, the lining layer 185 may be positioned on the exterior of the housing 113. The lining layer 185 may be at least 0.5 mm thick, at least 1 mm thick, at least 2 mm thick, at least 3 mm thick, at least 4 mm thick, at least 5 mm thick, or within a range defined by any two of the aforementioned thicknesses or thicker. The lining layer 185 and the components that make-up the lining layer 185, in addition to the additional features of device 100, unexpectedly reduce the sound emitted from the device to an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances.

In some embodiments, as illustrated for example, the gyroscope assembly 135 is separated from the drive assembly 137 by the interior wall 132. Thus, if a user opens the second end cap 119, for example to change the power source 181 (e.g., replace the batteries) or perform maintenance on the motor 173, the gyroscope assembly 135 is maintained in a sealed environment. This feature can inhibit particles and debris from entering into the first compartment 131 and interfering with and/or degrading the first and second bearings 147, 155 or other rotational components. Additionally, this feature also suppresses the noise of the device, preferably, to an auditory level that is below a threshold detectable by human hearing, such as below 50, 45, 40, 35, 30, 25, 20, 15, 10, 5, or 2 decibels (but not zero) or within a range of decibels defined by any two of the aforementioned values when sound is measured from 1, 2, 3, 4, 5, 6, 7, 8, 9, 10, 11, 12, 13, 14, 15, 16, 17, 18, 19, or 20 feet from the device or within a range of distances defined by any two of the aforementioned distances. Similarly, the coupling space 169 can be isolated from the first and second compartments 131, 135 and this feature may protect the coupling 179 and further suppress noise generated by the device.

As shown in the partially exploded views of FIGS. 1D and 1E, the housing 113 may comprise flanges 122. The flanges 122 may provide locations where the fasteners 127 that attach the first and second end caps 117, 119 to the housing 113.

One benefit that may be realized with the device 100 is that the device 100 is provided in a compact, self-contained form factor. This may have several benefits including that it allows the device 100 to be unobtrusively attached to the firearm. Further, it may make the device 100 easier to carrier (either when attached or unattached to the firearm), improving the portability of the device. Finally, because the device is self-contained, it may improve the simplicity and ease of use of the device 100.

Figure 2A:
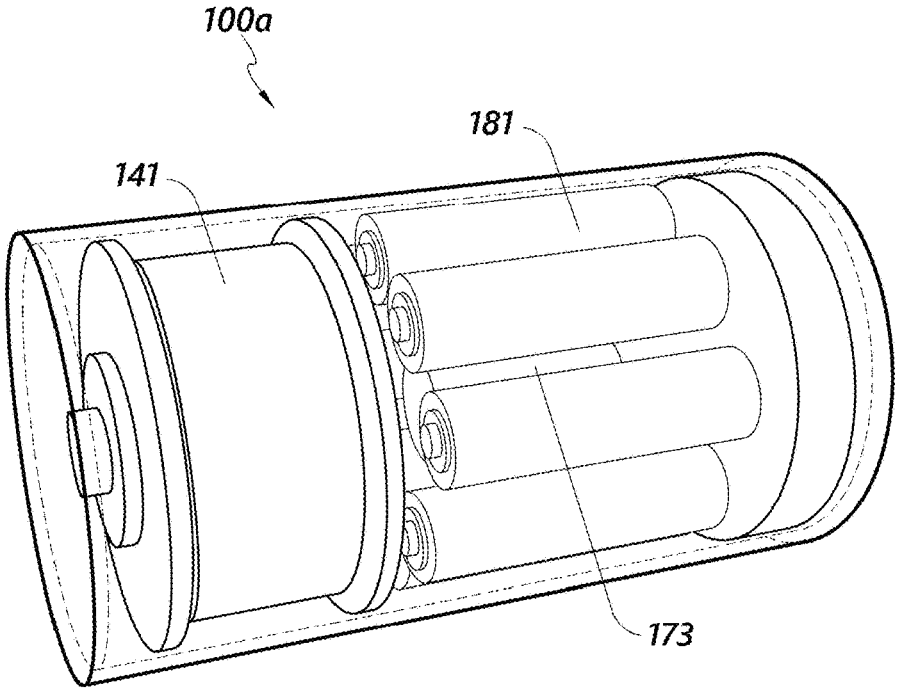
FIGS. 2A and 2B are perspective and side views, respectively, of an embodiment a firearm stabilization device that includes a power source that surrounds an electric motor.
Figure 2B:
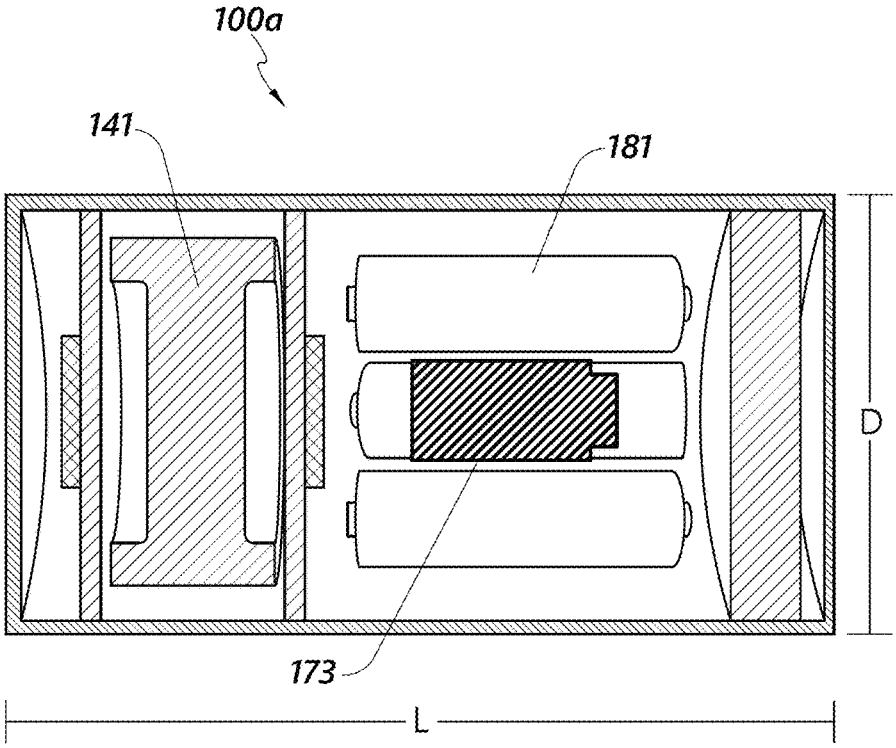
Figure 3A:
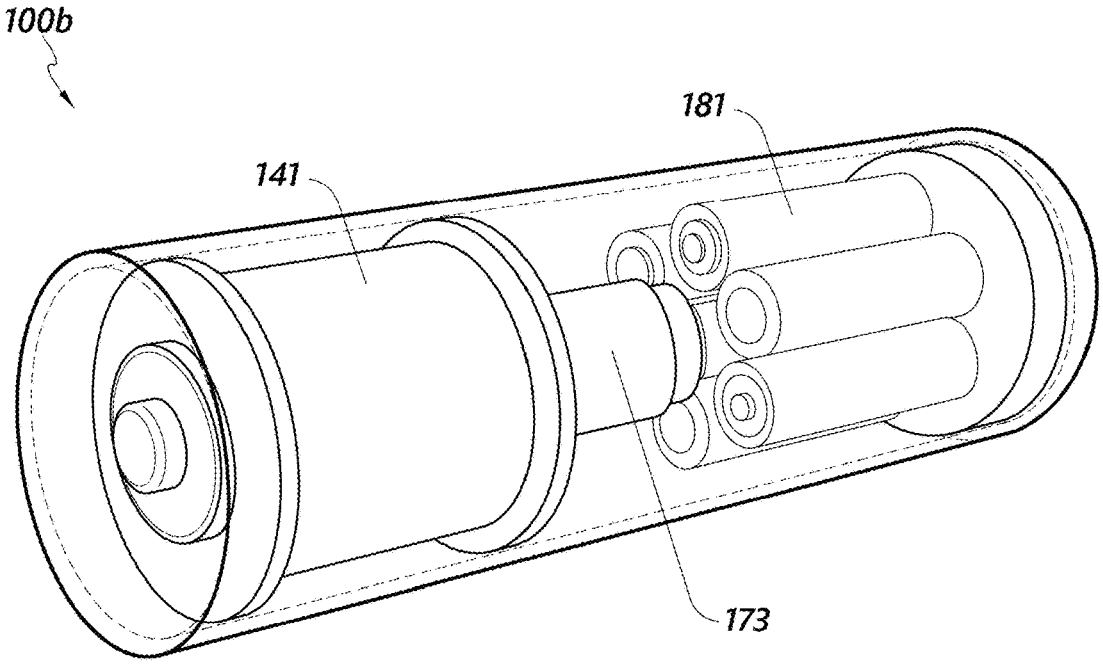
FIGS. 3A and 3B are perspective and side views, respectively, of an embodiment a firearm stabilization device that includes an electric motor positioned axially between a flywheel and a power source.
Figure 3B:
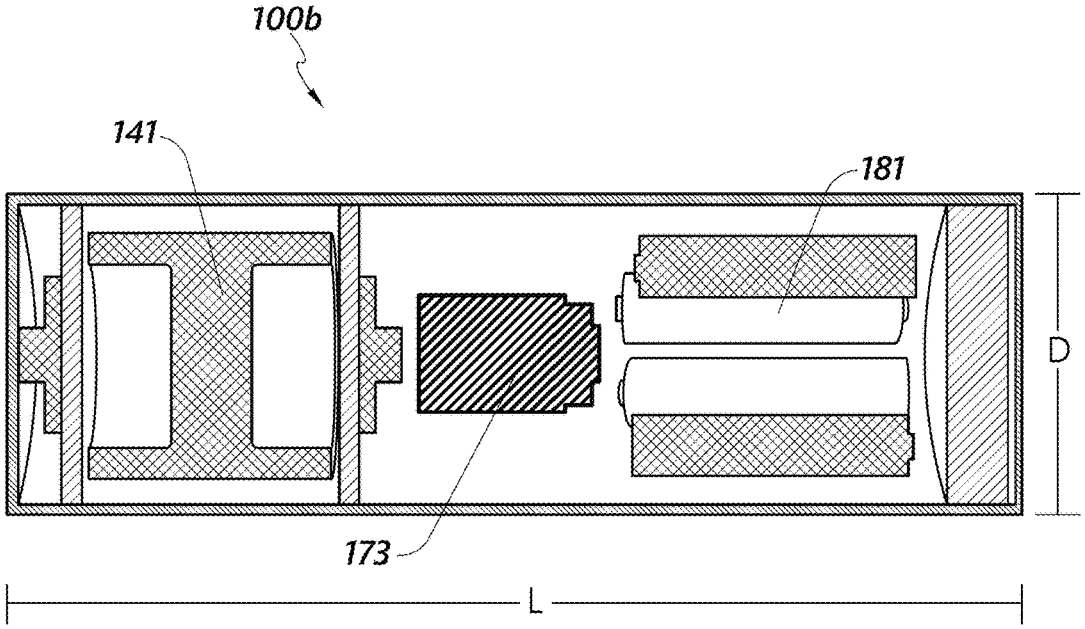

FIGS. 2A-3B illustrate example arrangements of the components of the device 100 that permit a compact and self-contained form factor. FIGS. 2A and 2B show perspective and side views, respectively, of an embodiment the device 100*a* that includes a power source 181 that surrounds an electric motor 173. FIGS. 3A and 3B are perspective and side views, respectively, of an embodiment the device 100*b* that includes an electric motor 173 positioned axially between the flywheel 141 and a power source 181. In FIGS. 2A-3B, some of the components of the devices 100*a*, 100*b* are omitted for clarity. It will be understood that the devices 100*a*, 100*b* can include many of the features of the device 100 shown and described with reference to FIGS. 1A-1E.

As illustrated in FIGS. 2A and 2B, the device 100*a* can include a power source 181 that surrounds the motor 173. For example, as illustrated, the power source 181 comprises a plurality of batteries positioned radially around the motor 173. This arrangement may allow for a shorter and wider form factor (with comparison to the embodiment shown in FIGS. 3A and 3B). The device 100*a* can include a diameter D and a length L as shown in FIG. 2B. In some embodiments, the diameter D may be between 4 cm and 10 cm, between 5 cm and 8 cm, between 6 cm and 8 cm, or 6.5 cm or within a range defined by any two of the aforementioned diameters. The length L may be between 8 cm and 16 cm, between 10 cm and 14 cm, or 14 cm or within a range defined by any two of the aforementioned lengths. Other diameters D and lengths L are also possible.

As illustrated in FIGS. 3A and 3B, in an alternative embodiment, the device 100*b* can comprise the motor 173 positioned axially between the power source 181 and the flywheel 141. This arrangement may allow for a longer and narrower form factor (with comparison to the embodiment shown in FIGS. 2A and 2B). The device 100*b* can include a diameter D and a length L as shown in FIG. 3B. In some embodiments, the diameter D may be between 3 cm and 8 cm, between 4 cm and 7 cm, between 5 cm and 6 cm, or 5.5 cm or within a range defined by any two of the aforementioned diameters. The length L may be between 15 cm and 20 cm, between 16.5 cm and 18.5 cm, or 17.5 cm or within a length defined by any two of the aforementioned lengths. Other diameters D and lengths L are also possible.

As noted previously, the device 100 is configured to be attached to a firearm to improve the stability of a firearm. The device 100 may be attached to many types of firearms including, rifles, pistols, and others. The device 100 is suitable for use with single shot, semi-automatic, or automatic firearms. The device 100 may be used to reduce "wobble" of the barrel during aiming, trigger pull, and/or discharge of the weapon. The device 100 may also be used to minimize or reduce recoil of the firearm after a shot (e.g., repositioning of the sites after semi-automatic or automatic firing of the weapon. Accordingly, the device 100 may be very suitable in rapid fire situations, aiding the user in holding the firearm on target over the course of successive shots.

The present inventors have discovered that, in some instances, the positioning of the device 100 on the firearm (i.e., the point of attachment between the device 100 and the firearm) can be an important factor in the efficacy of the device 100. Positioning of the device 100 on the firearm will be described with reference to FIGS. 4A and 4B.

Figure 4A:
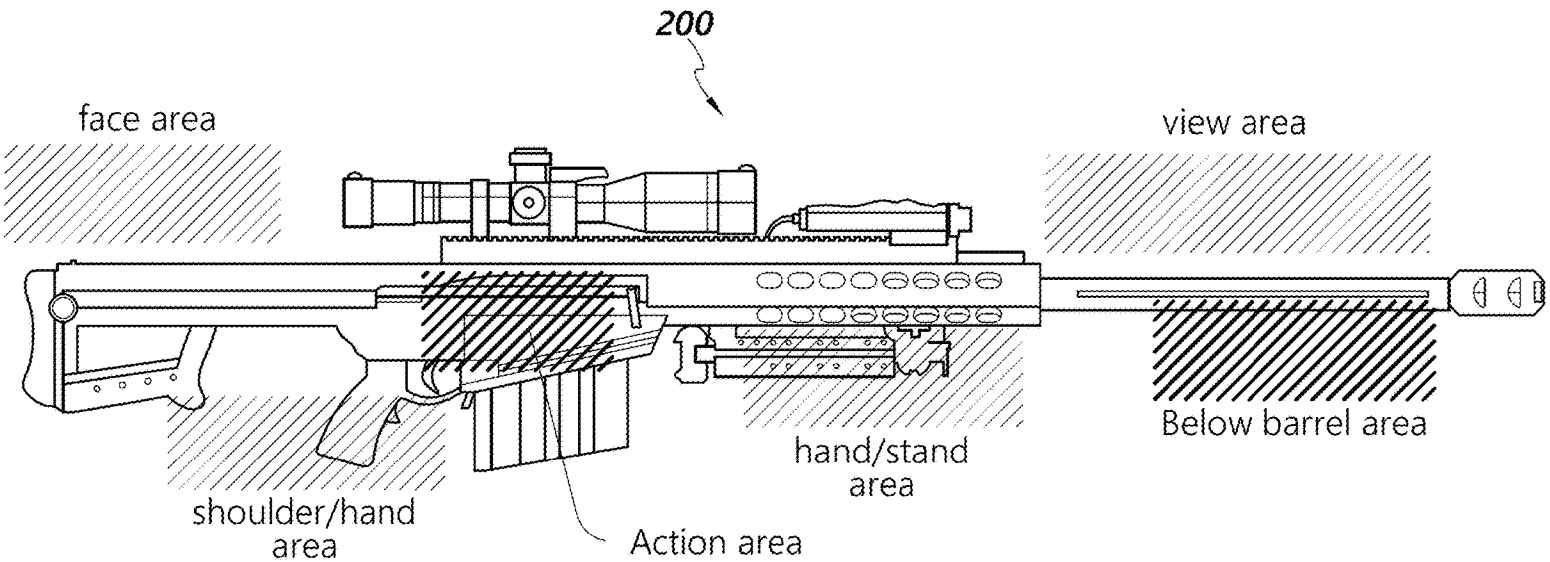
FIG. 4A is a side view of an embodiment of a firearm.

FIG. 4A is a side view of an embodiment of a firearm 200 and illustrates, generally, several areas on and around the firearm 200 where the device 100 could potentially be positioned. As illustrated, these areas include a face area, a shoulder/hand area, an action area, a hand/stand area, a view area, and a below barrel area. It may not be desirable to place the device 100 in many of these areas for various reasons. For example, positioning the device 100 in the face area or view area may limit a user's ability to properly aim the firearm. Positioning the device 100 in the shoulder/hand or the hand/stand area may limit a user's ability to properly hold the firearm. Positioning the device 100 in the action area may interfere with the operation of the firearm itself. Accordingly, placement of the device 100 in the below barrel area is preferred. However, the present inventors have discovered that the specific placement of the device 100 in the below barrel area may impact the stabilizing ability. This is described with reference to FIG. 4B.

Figure 4B:
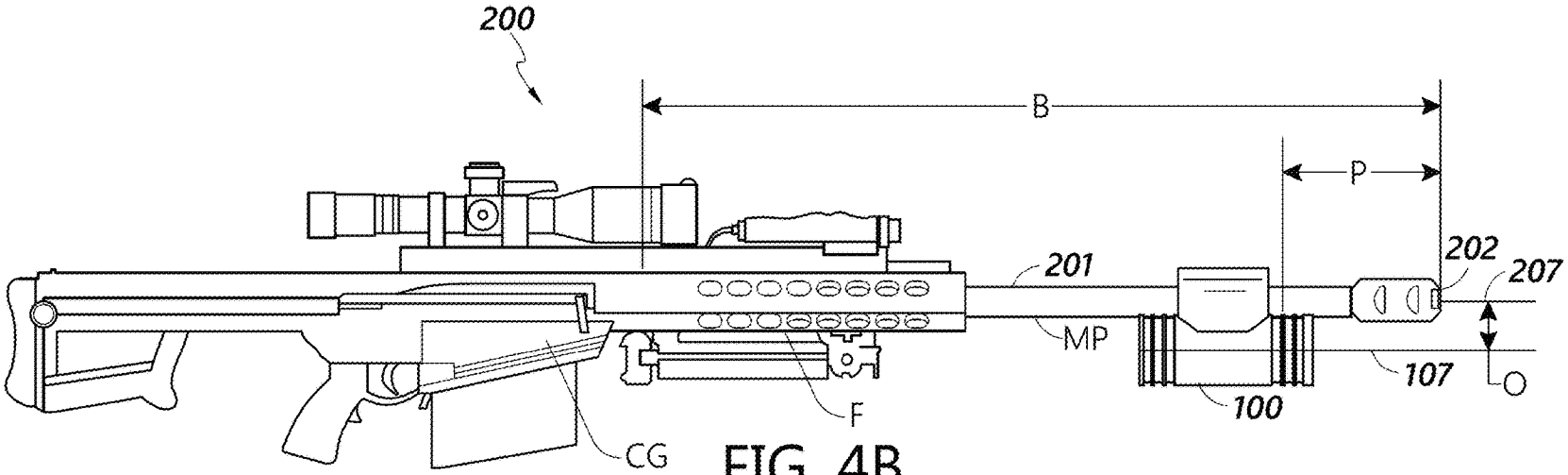
FIG. 4B is a side view of an embodiment of the firearm of FIG. 4A with a firearm stabilization device installed thereon.

FIG. 4B is a side view of the firearm 200 with the device 100 installed thereon in a position below the barrel 201. As shown, the axis 107 of the device 100 is aligned (i.e., parallel with) the axis 207 of the barrel 201.

In some embodiments, an offset O measured between the axis 107 of the device and the axis 207 of the barrel 201 is preferably between 10 cm and 2 cm, between 8 cm and 2 cm, between 6 cm and 2 cm, between 5 cm and 2 cm, or between 4 cm and 2 cm or within a range defined by any two of the aforementioned positions. In some embodiments, the offset O is greater than the diameter of the barrel but less than four diameters of the barrel, less than three diameters of the barrel, or less than 2 diameters of the barrel. In some embodiments, the offset O is between 60% and 100% the diameter of the flywheel 139 of the device 100. In some embodiments, the offset O is 80% the diameter of the flywheel 139 of the device 100.

In some embodiments, the device 100 is positioned a distance P from the end 202 of the barrel 201. The distance P is measured between the end 202 of the barrel 201 and the center (longitudinally) of the flywheel 149. In some embodiments, the distance P is no more than 25 cm, no more than 20 cm, no more than 15 cm, no more than 10 cm from the end 202 of the barrel 201 or within a range defined by any two of the aforementioned distances from the end 202 of barrel 201. In some embodiments, the distance P is at least 1 cm, at least 2 cm, at least 3 cm, at least 4 cm, or at least 5 cm from the end 202 of the barrel 201 or within a range defined by any two of the aforementioned distances from the end 202 of barrel 201.

In some embodiments, the barrel 201 comprises a length B. The device 100 may be positioned between a midpoint MP of the barrel 201 and the end 202 of the barrel 201. In some embodiments, the distance P is, no more than 25%, no more than 15%, or no more than 10% the length B of the barrel. In some embodiments, the distance P is at least 5% the length B of barrel 201.

The firearm 200 may comprise a center of gravity CG. In some embodiments, the device 100 is positioned between the CG and the end 202 of the barrel 201.

In some embodiments, a foregrip may be attached to the firearm 201 at the position F. The device 100 may be positioned between the position F of the foregrip and the end 202 of the barrel 201.

While FIGS. 4A and 4B describe and example of a rifle, similar principles may be used to guide placement of the device on other types of firearms, including pistols.

Figure 5:
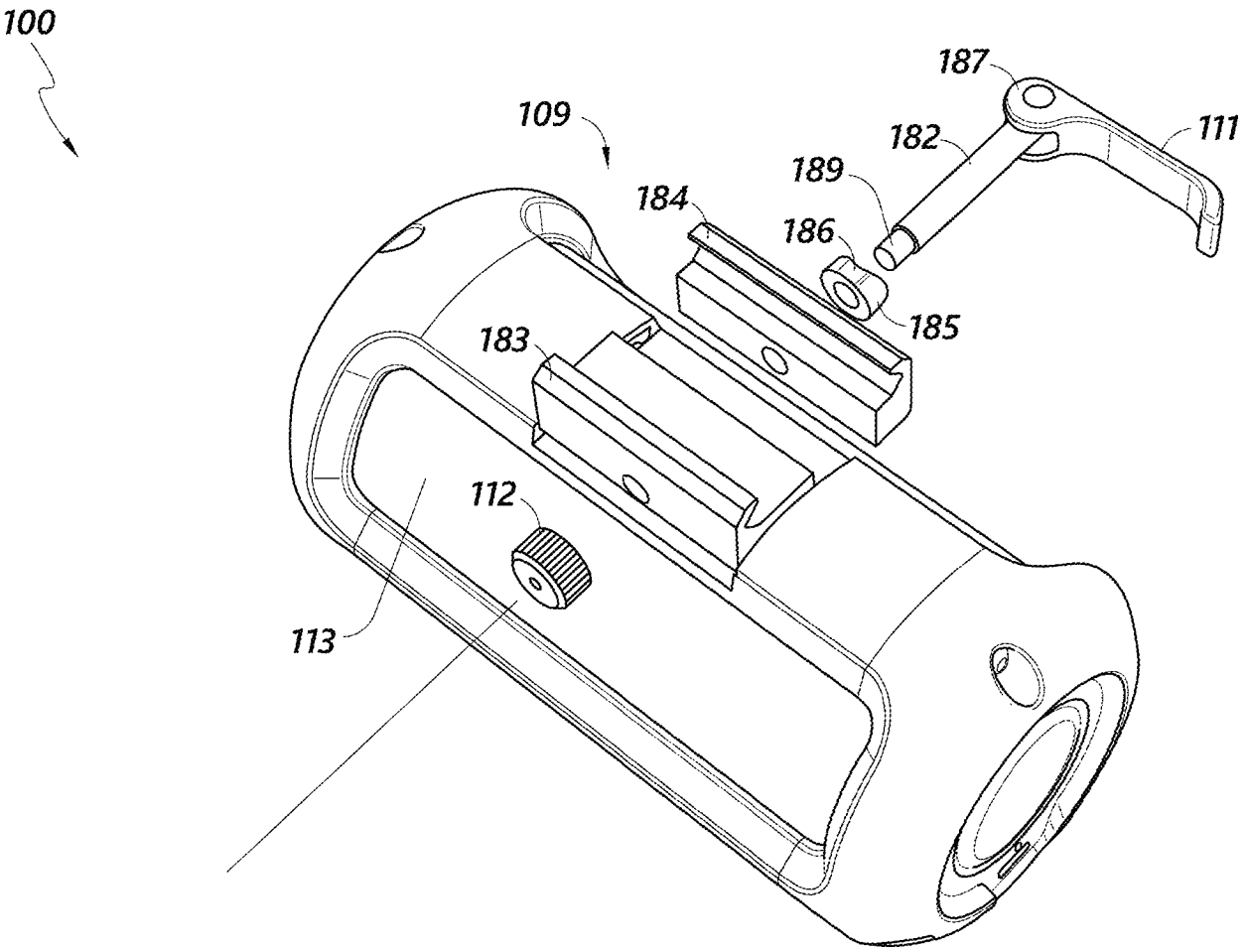
FIG. 5 is a partially exploded perspective view of an embodiment of an attachment mechanism for a firearm stabilization device.
Figure 6:
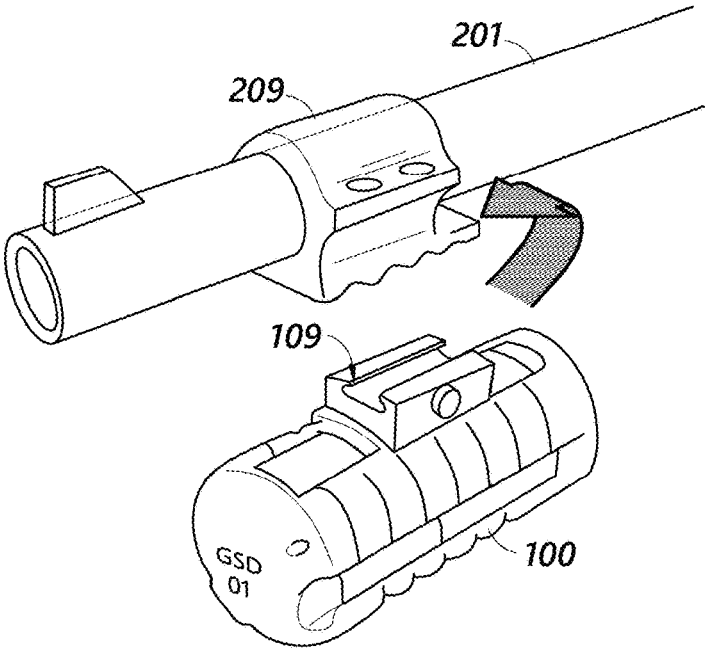
FIG. 6 is a perspective view of an embodiment of a firearm stabilization device configured for attachment to an accessory rail of a firearm.
Figure 7:
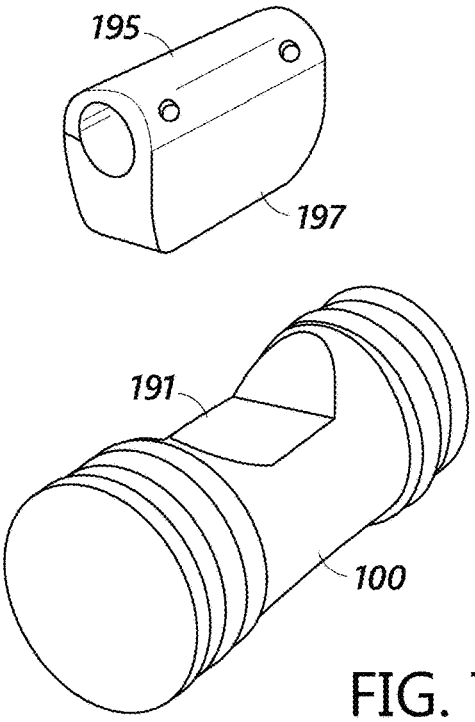
FIG. 7 is a perspective view of an embodiment of a firearm stabilization system that includes an embodiment of a magnetic attachment mechanism.

FIGS. 5-7 illustrate various embodiments of attachment mechanisms for mounting the device 100 to the firearm 200.

FIG. 5 is a partially exploded perspective view of an embodiment of the attachment mechanism 109 shown in FIGS. 1A-1E. The attachment mechanism 109 is configured as a quick-release attachment mechanism configured for use with the NATO accessory rail. Similar quick-release attachment mechanisms can be configured for use with other accessory rail systems.

As illustrated, for some embodiments, the attachment mechanism 109 includes a first jaw 183 and a second jaw 184. The first jaw 183 may be attached to the housing 183. That is, the first jaw 183 may be fixedly attached to the housing 113, either formed as a unitary piece with the housing or as a separate piece attached thereto. The second jaw 184 opposes the first jaw 183. The second jaw 184 is moveable relative the first jaw 183 to create a clamping force there between. In some embodiments, the second jaw 184 is not directly attached to the housing 113.

In the illustrated embodiment, a pin 182 is configured to extend through openings in the first and second jaws 183, 184. The second jaw 184 is moveable towards the second jaw 183 along the pin 182. On a side of the first jaw 183 opposite the second jaw 184, a threaded end 189 of the pin can be engaged with the adjustment knob 112. The opposite end of the pin 182 is attached to the locking handle 111. One end of the locking handle 111 includes a cam body 187. The cam body 187 is configured to apply a force on the second jaw 184 that moves the second jaw 184 towards the first jaw 183 when the locking handle 111 is closed. In some embodiments, a rubber compression ring 185 is positioned on the pin 182 between the second jaw 184 and the handle 111.

The first and second jaws 183, 184 may be configured in size and shape to engage with a NATO accessory rail, or any other firearm accessory rail. In some embodiments, the first and second jaws 183, 184 are configured to clamp directly onto the barrel 201 of the firearm 200.

FIG. 6 is a perspective view of an embodiment of a system that includes the device 100 and an accessory rail 209. The accessory rail 209 can be a NATO accessory rail, or any other type of firearm accessory rail. As shown, the accessory rail 209 is attached to or mounted on the barrel 201. The attachment mechanism 109 can then be used to attach the device 100 to the accessory rail 209. The system permits quick and easy attachment and removal of the device 100 from the firearm.

In some embodiments, the accessory rail 209 remains constantly attached to the barrel 201. The user may then selectively attach the device 100 quickly to the accessory rail 209 when desired. After use, the user may remove the device 100 for storage separate from the firearm or may leave the device 100 attached, if desired.

FIG. 7 is a perspective view of an embodiment of another embodiment of a system 100 that includes the device 100 and a barrel mounted attachment mechanism 195. In this embodiment, the device 100 includes a magnetic surface 191. The magnetic surface 191 may comprise magnets attached to or embedded in the device 100. The barrel mounted attachment mechanism 195 also includes a magnetic surface 197. A user may selectively attach the device 100 to the barrel mounted attachment mechanism 195 by magnetically engaging the magnetic surfaces 191, 197.

In some embodiments, the magnetic surfaces 191, 197 may be configured in size and shape for keyed engagement, that is, engagement that aligns the device 100 relative to the barrel mounted attachment mechanism 195. The shape of the magnetic surface 191 may be configured in size and shape to engage with the magnetic surface 197 in only a single orientation to ensure that the axis 107 of the device 100 remains aligned with the axis 207 of the barrel 200.

In some embodiments, the barrel mounted attachment mechanism 195 may be omitted, and the magnetic surface 191 of the device 100 may be configured for magnetic engagement directly with the barrel 201.

Figure 8A:
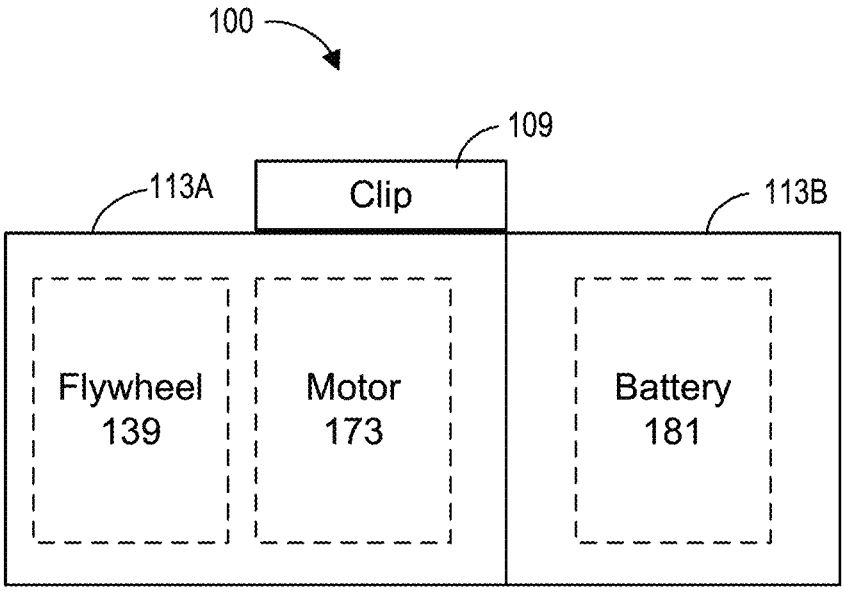
FIGS. 8A and 8B illustrate side views of an embodiment of a firearm stabilization device that includes a removable power source component.
Figure 8B:
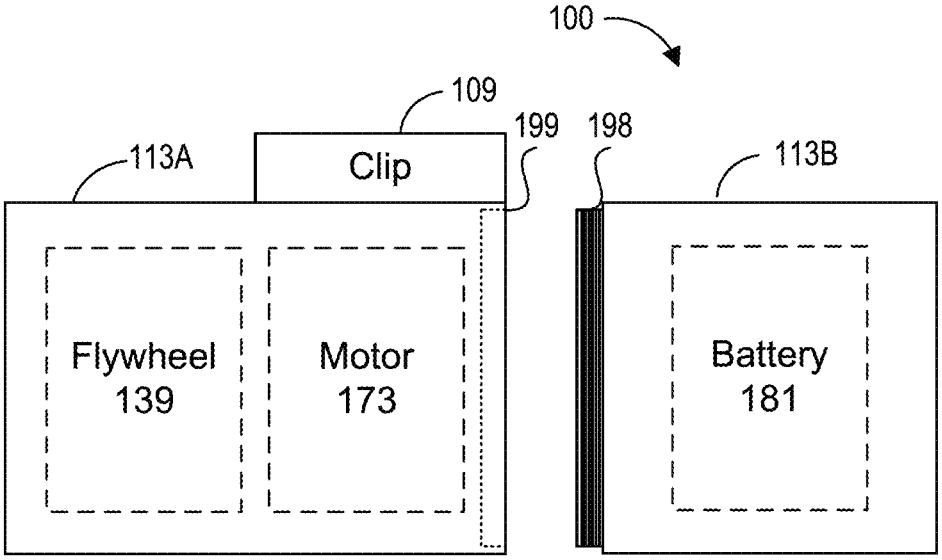

FIGS. 8A and 8B illustrate side views of an additional embodiment of the device 100 that includes a removable power source component 113B. In FIG. 8B, the removable power source component 113B is illustrated attached to the flywheel-motor component 113A. In FIG. 8B, the removable power source component 113B is illustrated unattached to the flywheel-motor component 113A.

As shown, in FIG. 8A, the device 100 includes a flywheel-motor component 113A. The flywheel 139 and the motor 173 are positioned within the flywheel-motor component 113A. A clip, such as engagement structure 109 is attached to the flywheel-motor component 113A to secure the device 100 to the firearm. The removable power source component 113B includes the power source 181 (e.g., a battery). The power source 181 may be embedded in the removable power source component 113B. When the removable power source component 113B is attached to the flywheel-motor component 113A as shown in FIG. 8A, the power source 181 provides power to the motor 173.

As shown in FIG. 8B, the removable power source component 113B includes a terminal 198. The terminal 198 may be threaded. Similarly, the flywheel-motor component 113A also includes a terminal 199. The terminal 199 may be threaded. To attach the removable power source component 113B to the flywheel-motor component 113A, the terminal 198 is engaged with the terminal 199. In some embodiments, the removable power source component 113B is threaded onto the flywheel-motor component 113A. In addition to providing physical engagement between the removable power source component and the flywheel-motor component 113A, the terminals 198, 199 also provide an electrical connection between the power source 181 and the motor 173.

The system of FIGS. 8A and 8B may allow quick and easy replacement of the power source 181. For example, when a first power source 181 runs out of power, the removable power source component 113B can be removed and replaced with a new, charged removable power source component 113B. Such power sources 113B can be easily brought into the field and transported (e.g., on tactical vests or body armor attachments) so as to allow for rapid replacement of failing power sources in the absence of electricity for recharging the power sources. In some embodiments, the removable power source component 113B is disposable. In some embodiments, the removable power source component 113B is rechargeable.

FIG. 9 illustrates various additional embodiments of the device 100. In particular, FIG. 9 illustrates various embodiments of round bodies, square bodies, and triangular bodies for the device. The features described above can be included in any of the devices shown in FIG. 9.

Example 1

The device 100 has been tested to evaluate its efficacy in stabilizing a firearm for several shooters of different skill levels. As shown, the device 100 improved the stability of the firearm for all shooters. While all shooters showed increased stability while using the device 100, novice shooters experienced the most dramatic increases.

For the testing, a SCATT WM9 was attached to the barrel of a rifle. The SCATT WM9 provides an electronic trace of the aim point of the firearm. Thus, the SCATT WM9 provides a method for visualizing a shooter's wobble while operating the firearm by analyzing the size of the area over which the shooter's aim wanders during aiming.

Five shooters were tested with and without the device 100. The five shooters included a beginner (male), a beginner (female) a hunter (male), an ex-infantry soldier (male), and a military SAS marksman (male).

Stability, as measured by the SCATT WM9 was compared between tests with and without the device 100 installed on the barrel. As shown in Table 1, stability improved for all shooters.

TABLE 1

Stability Increase When Using Device

| Shooter | Stability Increase |
|---|---|
| Beginner (male) | 81% |
| Beginner (female) | 78% |
| Hunter (male) | 42% |
| Ex-infantry solider (male) | 27% |
| Military SAS marksman (male) | 19% |

Example 2

An embodiment of the device 100 was tested with a sound meter to determine operational sound levels. The tested device operated at between 25-30 decibels. Quiet operation of the device, for example at sound levels less than 45 decibels may be desirable, especially in military and hunting applications. It is believed that the quiet operation of the present device is due in part to one or more of the following: the support structure and bearings supporting the flywheel, the multi-compartment housing, the lining layer, the overmolded portion, the motor mount, and/or the motor and flywheel designs.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the inventions are to cover all modifications, equivalents, and alternatives falling within the spirit and scope of the various embodiments described and the appended claims.

Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue."

It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components.

The ranges disclosed herein also encompass any and all overlap, sub-ranges, and combinations thereof. Language such as "up to," "at least," "greater than," "less than," "between," and the like includes the number recited. Numbers preceded by a term such as "approximately," "about," and "substantially" as used herein include the recited numbers, and also represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of the stated amount. Features of embodiments disclosed herein preceded by a term such as "approximately," "about," and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. A firearm stabilization device comprising:

a housing extending along an axis between a first end and a second end, the housing including at least a first compartment;

a gyroscope assembly positioned within the first compartment, the gyroscope assembly comprising a rotating member mounted on a rotatable shaft, the rotating member and the rotatable shaft configured to rotate around an axis of rotation;

a drive assembly positioned within housing, the drive assembly comprising:

a motor mount including a first portion attached to an interior wall of the housing, and an electric motor attached to the motor mount and configured to rotate the rotatable shaft of the gyroscope assembly;

an attachment mechanism positioned on an outer surface of the housing for fixedly attaching the stabilization device to a barrel of a firearm such that, in an attached state, the axis of rotation of the rotating member is parallel to a central axis of the barrel;

a power source electrically connected to the electric motor; and a button electrically connected to the electric motor and the power source for controlling the electric motor.

2. The firearm stabilization device of claim 1, wherein the attachment mechanism comprises a quick release assembly.

3. The firearm stabilization device of claim 2, wherein the quick release assembly comprises:

a first clamping jaw fixedly attached to the outer surface of the housing;

a moveable second jaw; and a handle actuable to move the second clamping jaw toward the first clamping jaw.

4. The firearm stabilization device of claim 3, wherein the first clamping jaw and the second clamping jaw are configured to attach to an accessory rail on the barrel of the firearm.

5. The firearm stabilization device of claim 4, wherein the accessory rail comprises a NATO accessory rail.

6. The firearm stabilization device of claim 1, wherein the attachment mechanism comprises a magnet for magnetically attaching the stabilization device to a corresponding magnetic connector on the barrel of the firearm.

7. The firearm stabilization device of claim 1, wherein the attachment mechanism comprises a magnet having an upper surface with a profile configured to magnetically engage the barrel of the firearm.

8. The firearm stabilization device of claim 1, wherein the attachment mechanism is removable from the firearm stabilization device.

9. The firearm stabilization device of claim 1, wherein the attachment mechanism comprises a keyed engagement structure configured to align the axis of rotation to the central axis of the barrel.

10. The firearm stabilization device of claim 1, wherein a layer of foam or insulation material is positioned on an inner surface of the housing in at least a portion of the first compartment.

11. The firearm stabilization device of claim 10, wherein the layer of foam or insulation material is at least 1 mm thick.

12. The firearm stabilization device of claim 1, wherein the barrel comprises a length, and the housing is configured to attach to the barrel no more than 15% the length of barrel from an end of the barrel distal to the user.

13. The firearm stabilization device of claim 1, wherein the housing is configured to attach to the barrel between a center of gravity of the firearm and an end of the barrel distal to the user.

14. The firearm stabilization device of claim 1, wherein, in the attached state, the axis of rotation and the central axis of the barrel are not coaxial.

15. The firearm stabilization device of claim 1, wherein, in the attached state, the axis of rotation is positioned below the central axis of the barrel.

16. The firearm stabilization device of claim 1, wherein the housing is cylindrical and an outer diameter of the housing is less than 7 cm but greater than 3 cm.

17. The firearm stabilization device of claim 1, wherein an outer diameter of the rotating member is 5 cm or less and greater than 2 cm.

18. The firearm stabilization device of claim 1, wherein the housing is waterproof.

19. The firearm stabilization device of claim 1, wherein, during operation, the stabilization device produces less than 50 decibels.

20. The firearm stabilization device of claim 1, wherein the rotating member comprises a flywheel.

* * * * *